United States Patent [19]

Kinoshita et al.

[11] 4,396,712

[45] Aug. 2, 1983

[54] DRY IMAGE FORMING MATERIAL

[75] Inventors: Shozo Kinoshita; Muneaki Kimura; Tetsuo Shiga, all of Fuji, Japan

[73] Assignee: Asahi Kasei Kogyo Kabushiki Kaisha, Osaka, Japan

[21] Appl. No.: 268,438

[22] Filed: May 29, 1981

[30] Foreign Application Priority Data

May 30, 1980 [JP] Japan ..... 55-71529
Jun. 20, 1980 [JP] Japan ..... 55-82792
Jul. 10, 1980 [JP] Japan ..... 55-93238

[51] Int. Cl.[3] ..... G03C 1/02

[52] U.S. Cl. ..... 430/614; 430/600; 430/618; 430/619; 430/620

[58] Field of Search ..... 430/614, 618, 619, 620, 430/600

[56] References Cited

U.S. PATENT DOCUMENTS 3,152,904 10/1967 Sorensen et al. ..... 430/966
3,764,329 10/1973 Lee ..... 430/353
3,802,888 4/1974 Willits ..... 430/203
4,307,187 12/1981 Ikenoue et al. ..... 430/620

FOREIGN PATENT DOCUMENTS 54-48537 4/1979 Japan ..... 430/614

*Primary Examiner*—Won H. Louie, Jr.
*Attorney, Agent, or Firm*—Sprung, Horn, Kramer & Woods

[57] ABSTRACT

A novel dry image forming material comprising in one or more layers on a support (a) a non-photosensitive organic silver salt oxidizing agent, (b) a reducing agent for silver ions, (c) a silver halide component or a silver halide-forming component, (d) a toning agent and (e) a lipophilic binder, characterized by the inclusion of a specific 2-(2′-hydroxyphenyl)benzotriazole compound having bulky tert-butyl or tert-amyl groups at its ortho- and para-positions relative to the hydroxyl group in a layer containing the component (a). The dry image forming material of the present invention has high storage stability prior to use for image formation. When the dry image forming material comprises a combination of a silver salt oxidizing agent-containing layer comprising the specific 2-(2′-hydroxyphenyl)benzotriazole compound and a reducing agent-containing layer comprising a high impact acrylic resin as a binder material, the material is remarkably improved in storage stability of raw material in the dark or under light with wavelengths of 450 nm or more and the stability of a latent image, and shows minimized variation in image quality with heat development conditions. When the dry image forming material comprises, as the component (a), a silver salt of long chain fatty acid having 16 or more carbon atoms and, as the component (c), a silver halide component including silver iodide or a silver halide-forming component capable of forming a silver halide component including silver iodide, and further comprises (g) an oxidizing agent for free silver, (h) a photoreactive halogeno oxidizing agent and, in the layer containing the components (a), (c), (e) and (f), (i) a specific cyanine spectral sensitizing dye, the material is of the post-activation type and spectrally sensitized without sacrificing the storage stability of raw material.

4 Claims, No Drawings

DRY IMAGE FORMING MATERIAL

This invention relates to a dry image forming material. More particularly, the present invention relates to a dry image forming material which is improved in stability during the storage thereof prior to use for image formation (hereinafter often referred to as "storage stability of raw material"), and which can further be improved in latent image stability and image quality, and which can advantageously be rendered subject to much less variation of image quality with heat development conditions which may change.

As one class of dry image forming materials on which a visible image can be formed by only a dry process involving heating, there have been proposed heat-developable dry image forming materials which essentially comprise a non-photosensitive organic silver salt oxidizing agent, a reducing agent for silver ions, a catalytic amount of a silver halide or a silver halide-forming compound, and a binder.

The dry image forming materials of the silver salt type as described above include those which are photosensitive under normal lighting conditions (hereinafter often referred to as "already photosensitive type dry image forming material"), such as disclosed in U.S. Pat. Nos. 3,152,904 and 3,457,075, and those which are non-photosensitive under normal lighting conditions (hereinafter often referred to as "postactivation type dry image forming material"), such as disclosed in U.S. Pat. Nos. 3,764,329, 3,816,132, 4,113,496, and 4,173,482. The latter image forming materials can be handled under room light, provided they are not activated, and can be rendered photosensitive when they are activated, for example, by heating the same prior to exposure to light. The former image forming materials can form thereon a visible image when subjected to imagewise exposure to light and subsequent heat development, whereas the latter image forming materials can form thereon a visible image when subjected to preliminary heat activation, imagewise exposure to light and subsequent heat development.

The dry image forming materials of the silver salt type are superior in simplicity of image forming procedures to the conventional wet process silver halide photographic materials because they can form thereon an image by only heating without the use of any liquid chemical agents. However, they are so poor in storage stability of raw material as to be readily subject, during their storage prior to use for image formation, to deterioration in image forming characteristics. More specifically, they, after stored, are liable to be blackened even in the light-unexposed portions by image forming procedures to form an image having a dark background, that is, they are prone to undergo the so-called fogging in image formation. Also, they are apt to become poor in sensitivity during the course of storage thereof. Further, since the image forming characteristics of the materials inherently are largely dependent on the conditions of heat development for visible image formation, the quality of images formed on the materials greatly varies when the heat development conditions change. Furthermore, these dry image forming materials are apt to undergo some deterioration in capability of forming a visible image during the period between light exposure and heat development, and, hence, the quality of images formed thereon is poorer as the abovementioned period is longer. Thus, they are poor in latent image stability.

There have been proposed post-activation type dry image forming materials as disclosed in U.S. Pat. Nos. 3,802,888 and 3,764,329, wherein the incorporation of a spectral sensitizing dye into a dry image forming material is mentioned. These proposed post-activation type dry image forming materials, however, are defective either in that they are so poor in light or storage stability of raw material as to undergo marked deterioration in their photographic or sensitometric characteristics when stored under lighting conditions or when exposed to high temperatures even if stored in the dark, or in that they are too insufficient in sensitivity to be used in photographing. As the stability of a raw image forming material is increased, the sensitivity of the material is apt to be decreased, whereas the stability of a raw image forming material is apt to be decreased as the sensitivity of the material is increased. Therefore, none of the conventional post-activation type dry image forming materials are good in both stability and sensitivity.

Accordingly, there has been earnestly desired such a dry image forming material as can meet such requirements that it should not substantially undergo any deterioration in image forming characteristics during storage thereof prior to use, that it should not be so much affected in quality of an image formed thereon by the variation in heat development conditions, that it should give, after preliminary heating and light exposure, a latent image which is excellent in stability, and that it should be spectrally sensitized but have excellent storage stability of raw material.

As is described in Japanese Patent Application Laid-Open Nos. 122430/1976 and 28417/1978, a combined use of benzotriazole and benzenethiosulfonic acid or its sodium salt or a combined use of benzotriazole and sulfinic acid may be effective for improving the storage stability of dry image forming materials. However, the incorporation of benzotriazole greatly lowers the sensitivity of the dry image forming materials, as is apparent from the results of Comparative Example 24 which will be given later. Thus, repeatedly stated, it is quite natural that the storage stability of a raw image forming material be increased with the sensitivity of the material being decreased.

On the other hand, as is disclosed in U.S. Pat. Nos. 3,004,896 and 3,189,615, 2-(2'-hydroxyphenyl)benzotriazoles can function as ultraviolet absorbers, and, hence, are known to be effective as anti-photodegradation agents for polymers. It is described in U.S. Pat. No. 3,253,921 that the use of a 2-(2'-hydroxyphenyl)benzotriazole in a filter layer on the photographic emulsion layer of a wet process color photographic material is effective for avoiding the loss of color balance due to too strong development of blue color undesirably caused by the irradiation of the material with ultraviolet rays and for preventing the fading and/or discoloration of a colored image formed on the material. Thus, 2-(2'-hydroxyphenyl)benzotriazoles have been used as the ultraviolet absorbers. However, no investigations have been made on the action or function of 2-(2'-hydroxyphenyl)benzotriazoles as stabilizers in the dark free of ultraviolet rays or in the case of exposure to light with wavelengths of 450 nm or more incapable of being absorbed by the 2-(2'-hydroxyphenyl)benzotriazoles.

It is an object of the present invention to provide a dry image forming material having high sensitivity and excellent storage stability of raw material.

It is another object of the present invention to provide a dry image forming material of the above character, which can give a stable latent image, and which can form an image of high quality, which is not so much dependent on heat development conditions.

Still another object of the present invention is to provide a practically usable post-activation type dry image forming material which is spectrally sensitized but has high sensitivity and excellent storage stability of raw material, and which can form an image of high quality.

With a view to developing dry image forming materials of the character as described above, we have made extensive and intensive investigations to find that such dry image forming materials can be obtained when a specific 2-(2'-hydroxyphenyl)benzotriazole having tert-butyl or tert-amyl groups at the 3'-and 5'-positions is incorporated in the layer of the materials containing an organic silver salt oxidizing agent. We have completed the present invention based on such a finding.

More specifically, in accordance with the present invention, there is provided a dry image forming material comprising in one or more layers on a support:

(a) a non-photosensitive organic silver salt oxidizing agent, (b) a reducing agent for silver ions, (c) a silver halide component or a silver halide-forming component capable of forming a silver halide component by the reaction thereof with the component (a), (d) a toning agent, (e) a lipophilic binder, and (f) at least one member selected from the group consisting of those compounds represented by the following formulae;

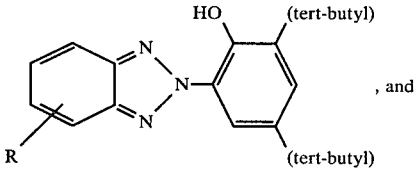

(I)

, and

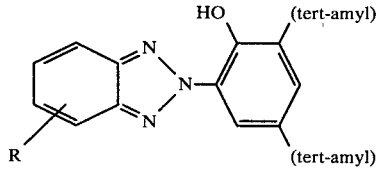

(II)

wherein R stands for a hydrogen atom, a $C_1$–$C_8$ straight or branched chain alkyl group, a $C_1$–$C_4$ straight or branched chain alkoxyl group, a phenyl group or a halogen atom selected from Cl, Br and I;
the component (f) being included in a layer containing the component (a).

The dry image forming material according to the present invention, whether it is either of the post-activation type or of the already photosensitive type, is improved in storage stability of raw material during its storage in the dark, and especially in suppression of fogging in and retention of sensitivity of the material stored under high temperatures and/or high humidities. Furthermore, in the case of the post-activation type dry image forming material according to the present invention, its storage stability of raw material is improved not only when it is stored in the dark under high temperatures and high humidities but also when it is stored in a light room.

According to a preferred embodiment of the present invention, the dry image forming material comprises a layer comprising the component (b) and, as a material of the component (e), a high impact acrylic resin having an Izod impact strength (notched) of at least 0.4 ft.lb/in as measured in accordance with ASTM D 256 and provided on a layer comprising at least the components (a), (c), (e) and (f), whereby it is improved in latent image stability and is subject to less variation of image quality with heat development conditions.

When the dry image forming material according to the present invention comprises, as the component (a), a silver salt of long chain fatty acid having 16 or more carbon atoms and, as the component (c), a silver halide component including silver iodide or a silver halide-forming component capable of forming a silver halide component including silver iodide, and further comprises (g) an oxidizing agent for free silver and (h) a photoreactive halogeno oxidizing agent, the image forming material is desirable as being of the post-activation type. The post-activation tye dry image forming material of the present invention as mentioned just above preferably further comprises, in the layer containing the components (a), (c), (e) and (f), (i) a cyanine spectral sensitizing dye with a unique chemical structure, which performs without sacrificing the storage stability of raw material by virtue of the component (f), i.e., a specific 2-(2'-hydroxyphenyl)benzotriazole, so that the dry image forming material remains practically useful with an increased sensitivity.

The cyanine spectral sensitizing dye (i) consists of at least one compound selected from those compounds represented by the following formulae:

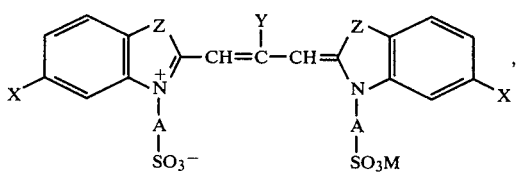

(III)

,

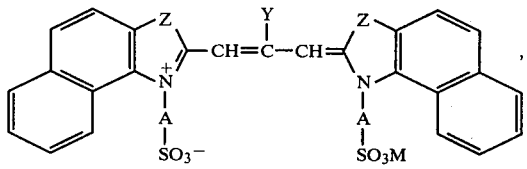

(IV)

,

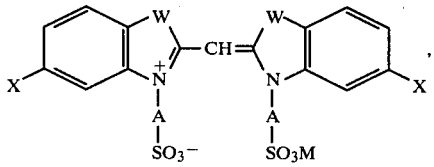

(V)

, and

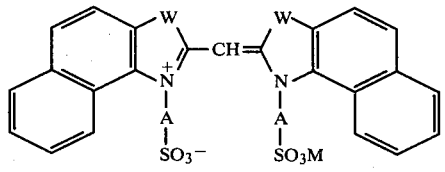

(VI)

wherein each X independently stands for a hydrogen atom, a methyl group, a chlorine atom, a phenyl group, a methoxy group or an acetamido group, Y stands for a hydrogen atom, a methyl group or an ethyl group, each Z independently stands for a selenium atom, a sulfur atom or an oxygen atom, each W independently stands for a selenium atom or a sulfur atom, each A independently stands for a $C_2$–$C_4$ straight or branched chain alkylene group, and M stands for a hydrogen atom, a triethylammonium group, a pyridinium group or a sodium atom.

It is well known to those skilled in the art that it is very difficult to apply the knowledge and technique acquired and the various additives used in the field of wet process silver halide photographic materials to the field of dry process photographic or image-forming materials, because both types of the material are quite different in components and mechanism of image formation. More specifically, the dry image forming material of the silver salt type, which is generally heated at a temperature of at least 100° C. for effecting the development thereof, comprises an organic silver salt oxidizing agent and a reducing agent required for image development, and a silver halide component or a silver halideforming component as the catalyst, while the wet process silver halide photographic material contains no reducing agent for development. Therefore, in the case of the dry image forming material of the silver salt type, it is all the more difficult because of the presence therein of the reducing agent to improve the storage stability of raw material without sacrificing the sensitivity of the material. It is particularly noted that post-activation type dry image forming materials, which are required to be capable of being exposed to or stored under normal lighting conditions substantially without undergoing deterioration in their photograhic or sensitometric characteristics, are quite different in conditions of storage and image formation from the wet process photographic material and even dry image forming materials of the already photosensitive type which are never exposed to light prior to use in image formation. Therefore, it is quite impossible to anticipate whether or not an additive suitable for those wet process photographic materials or those dry image forming materials of the already photosensitive type can be used successfully in post-activation type dry image forming materials. In fact, it is rather natural that such an additive be unable to be used in a post-activation type dry image forming material since incorporation of the additive into the post-activation type dry image forming material quite often results in low light or storage stability of the raw dry image forming material.

It has never been knon that, among such 2-(2'-hydroxyphenyl)benzotriazoles as known as the ultraviolet absorbers, only those having bulky tert-butyl or tert-amyl groups at their ortho- and para- positions relative to the hydroxyl group at the 2'-position are capable of improving a dry image forming material comprising a nonphotosensitive organic silver salt oxidizing agent, a reducing agent for silver ions, a silver halide component or a silver halide-forming component and a binder, in respect of storage stability of raw material in the dark free of ultraviolet rays. It also is beyond usual expectations and quite surprising that such 2-(2'-hydroxyphenyl)benzotriazoles as cannot absorb light with wavelengths of 450 nm or more are capable of improving a dry image forming material such as mentioned above, in respect of stability of raw material being stored under light with wavelengths of 450 nm or more.

In the case of wet process silver halide photographic materials and heat-developable dry image forming materials of the already photosensitive type, spectral sensitizing dyes as commonly used in these materials are not necessarily required to be stable to light irradiation and heating since the materials are never exposed to light and heat prior to use in image formation. In fact, unstable spectral sensitizing dyes are widely used in the above-mentioned materials. Therefore, it is usual that the technique of spectral sensitization acquired in the field of wet process silver halide photographic materials and dry image forming materials of the already photosensitive type be unable to be applied to the field of post-activation type dry image forming materials because it naturally tends to downgrade the resulting post-activation type dry image forming materials in respect of storage stability of raw material.

For example, as is disclosed in U.S. Pat. No. 3,933,507, incorporation of a spectral sensitizing dye into a system comprising an organic silver salt oxidizing agent and a reducing agent for silver ions but no photosensitive silver halide may often result in a dry image forming material of the common already photosensitive type. As will be easily understood from this instance, a spectral sensitizing dye incorporated into an image forming system has a tendency to impart photosensitivity to the system as long as it is not decomposed. Accordingly, in the case of a post-activation type dry image forming material which is required to be capable of being exposed to light prior to use and of being preliminarily heated prior to image-wise exposure to light substantially without deterioration of its photographic or sensitometric characteristics and not to undergo substantial fogging, a spectral sensitizing dye, if incorporated into the material, generally downgrades drastically the light or storage stability of the raw image forming material and renders the material more subject to fogging.

Almost all of the attempts to use in post-activation type dry image forming materials spectral sensitizing dyes as commonly used in wet process silver halide photographic materials and heat-developable dry image forming materials of the already photosensitive type have failed either because the spectral sensitizing dyes adversely affect the stability of the resulting raw post-activation type dry image forming materials so that they cause the resulting dry image forming materials to undergo fogging at the step of preliminary heating prior to light exposure and the escalation of the fogging at the step of heat development, or because the spectral sensitizing dyes themselves are so decomposed or bleached in the post-activation type dry image forming materials as not to exhibit any spectrally sensitizing capability from the outset, or as to lose their spectrally sensitizing capability too rapidly during the storage of the raw materials to be practically useful.

Furthermore, the spectral sensitizing dyes generally render the resulting image forming materials more subject to the influences of halation and/or irradiation than those image forming materials not spectrally sensitized. In order to obtain a high quality image with a high resolution on a spectrally sensitized image forming material, a means for preventing halation and/or irradiation is usually necessary for the image forming material. It is noted that it has been very difficult to employ in post-activation type dry image forming materials such halation- and/or irradiation-preventing means as employed in wet process silver halide photographic materials and dry image forming materials of the already photosensitive type, because, as described above, the post-activation type dry image forming materials are required to have good stability of raw material even when stored under severer conditions. Accordingly, it is quite unexpected that the specific 2-(2'-hydroxyphenyl)benzotriazoles incapable of absorbing light with wavelengths of 450 nm or more, when incorporated into post-activation type dry image forming materials, can contribute to preventing the quality of images formed on the materials from lowering due to halation and/or irradiation which occurs only when the image forming materials have an increased spectral sensitivity to light with long wavelengths of 450 nm or more, as well as to improving the storage stability of raw material in the dark or under light with wavelengths of 450 nm or more.

It is demonstrated, for example, in Examples of U.S. Pat. No. 3,589,903 that in dry image forming materials a layer comprising a polymer binder and a reducing agent may be provided on a layer containing silver salt oxidizing agent, the polymer binder being polyvinyl pyrrolidone or cellulose acetate. It is generally known that various polymers are usable as the binder of a reducing agent-containing layer provided on a silver salt oxidizing agent-containing layer.

It has unexpectedly and surprisingly be found that a combination of a silver salt oxidizing agent-containing layer comprising a specific 2-(2'-hydroxyphenyl)benzotriazole having a unique chemical structure and a reducing agent-containing layer comprising as a binder material a high impact acrylic resin having an Izod impact strength (notched) of at least 0.4 ft.lb/in as measured in accordance with ASTM D 256 can give dry image forming materials remarkably improved in storage stability of raw material in the dark or under light with wavelengths of 450 nm or more and the stability of a latent image as well as in suppression of variation of image quality according to varied heat development conditions.

With respect to the components of the dry image forming material of the present invention, a detailed explanation will now be given as follows.

As the non-photosensitive organic silver salt oxidizing agent (a) to be used in the dry image forming material of the present invention, there can be mentioned, for example, silver salts of long chain fatty acids, saccharin or benzotriazole. Preferred are silver salts of long chain fatty aids such as silver behenate, silver stearate, silver palmitate, silver myristate, silver laurate, silver oleate, silver margarate, silver arachidate, silver cerotate and silver milissinate. Most preferred is silver behenate. In the case of the post-activation type dry image forming material according to the present invention, preferred examples of the non-photosensitive organic silver salt oxidizing agent (a) include silver salts of long chain fatty acids with 16 or more carbon atoms, such as, silver palmitate, silver margarate, silver stearate, silver arachidate, silver behenate, silver cerotate and silver melissinate, of which silver behenate is most preferred. The organic silver salt oxidizing agent (a) is used preferably in an amount of about 0.1 to about 50 g/m$^2$, more preferably 1 to 10 g/m$^2$ of the support area of the present image forming material.

As the reducing agent for silver ions to be used as the component (b) of the dry image forming material of the present invention, there is used an organic reducing agent which has such a suitable reducing ability that, when heated, it reduces the non-photosensitive long chain fatty acid silver salt (a) with the aid of catalysis of the free silver produced from silver halide in the exposed portions of the activated dry image forming material to form a visible silver image. Examples of the silver ion-reducing agents include monohydroxybenzenes such as p-phenylphenol, p-methoxyphenol, 2,6-di-tert-butyl-4-methylphenol and 2,5-di-tert-4-methoxyphenol; polyhydroxybenzenes such as hydroquinone, tert-butylhydroquinone, 2,6-dimethylhydroquinone, chlorohydroquinone and catechol; naphthols such as α-naphthol, β-naphthol, 4-aminonaphthol and 4-methoxynaphthol; hydroxybinaphthyls such as 1,1'-dihydroxy-2,2'-binaphthyl and 4,4'-dimethoxy-1,1'-dihydroxy-2,2'-binaphthyl; phenylenediamines such as p-phenylenediamine and N,N'-dimethyl-p-phenylenediamine; aminophenols such as N-methyl-p-aminophenol and 2,4-diaminophenol; sulfonamidophenols such as p-(p-toluenesulfonamido)phenol and 2,6-dibromo-4-(p-toluenesulfonamido)phenol; and methylenebisphenols such as 2,2'-methylenebis(4-methyl-6-tert-butylphenol), 2,2'-methylenebis(4-ethyl-6-tert-butylphenol), 2,2'-methylenebis[4-methyl-6-(1-methylcyclohexyl)phenol], 1,1-bis(2-hydroxy-3,5-dimethylphenyl)-3,5,5-trimethylhexane, 2,6-bis(2'-hydroxy-3'-tert-butyl-5'-methylbenzyl)-4-methylphenol and 1,1-bis(2-hydroxy-3-tert-butyl-5-methylphenyl)pentane. A suitable reducing agent may be chosen depending on the kind of organic silver salt oxidizing agent (a) employed in combination therewith. Preferred are phenols. More preferred are hindered phenols in which one or two sterically bulky groups are bonded to the carbon atom or carbon atoms contiguous to the hydroxyl group-bonded carbon atom to sterically hinder the hydroxyl group. Such hindered phenols have a high stability to light and, hence, the use thereof is effective for assuring a high storage stability of raw material especially in the case of the post-activation type dry image forming material. As examples of such hindered phenols, there can be mentioned 2,6-di-tert-butyl-4-methylphenol, 2,2'-methylenebis(4-methyl-6-tert-butylphenol), 2,2'-methylenebis(4-ethyl-6-tert-butylphenol), 2,4,4-trimethylpentylbis(2-hydroxy-3,5-dimethylphenyl)methane (i.e., 1,1-bis(2-hydroxy-3,5-dimethylphenyl)-3,5,5-trimethylhexane), 2,6-methylenebis(2-hydroxy-3-tert-butyl-5-methylphenyl)-4-methylphenol, 2,2'-methylenebis[4-methyl-6-(1-methylcyclohexyl)phenol] and 2,5-di-tert-butyl-4-methoxyphenol. These reducing agents may be used either alone or in combination. The suitable amount of the reducing agent is usually in the range of from 0.1 to 3 moles per mol of the organic silver salt oxidizing agent (a).

The component (c) to be used in the dry image forming material of the present invention is a silver halide component or a silver halide-forming component capable of forming a silver halide component by the reaction thereof with the organic silver salt oxidizing agent (a). Examples of the silver halide include silver chloride, silver bromide, silver iodide, silver bromoiodide and silver chlorobromide. They may be used either alone or in combination. As usual in the field of photographic film manufacture, a silver halide(s) may be formulated as the silver halide component (c), together with other components such as the organic silver salt oxidizing agent, into a composition for providing the image forming coating or layer of the dry image forming material, as is disclosed in U.A. Pat. No. 3,152,904. Alternatively, a silver halide(s) can be prepared in situ either in a composition for providing the image forming coating of the dry image forming material or in the coated image forming layer of the dry image forming material, by the reaction of a silver halide-forming component (c) with part of the organic silver salt oxidizing salt (a), as is disclosed in U.S. Pat. No. 3,457,075. As the silver halide-forming component (c) that is used in the latter mode mentioned above and which is a kind of halogenating agent, there can be mentioned (i) hydrogen halides; (ii) metal halides; (iii) halogen molecular species and complexes thereof (see U.S. Pat. No. 4,173,482), (iv) organic N-haloamides containing a unit of the formula —CONX— or —$SO_2NX$— wherein X is chlorine, bromine or iodine (see U.S. Pat. No. 3,764,329), (v) arylhalomethanes (see U.S. Pat. No. 4,188,266), (vi) organic halides of elements belonging to Group IV, V or VI of the periodic table and having an atomic number of 14 or more (see U.S. Pat. No. 4,133,496), and (vii) combinations of an organic compound of an element belonging to Group IV, V or VI of the periodic table and having an atomic number of 14 or more with either (iii) a halogen molecular species or a complex of a halogen molecular species, or (iv) an organic N-haloamide (see U.S. Pat. No. 4,113,496). They may be used either alone or in combination. Specific examples of the halogenating agent include compounds respectively represented by the formulae:

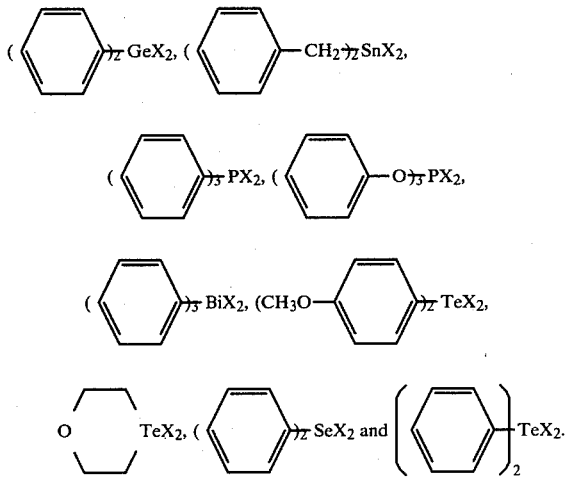

In the above formulae, X is bromine or iodine. Further specific examples of the halogenating agent include iodine, bromine, iodine bromide, a complex of triphenyl phosphite and iodine, a complex of p-dioxane and iodine, a complex of p-dioxane and bromine, N-bromo(or -iodo)phthalimide, N-bromo(or -iodo)succinimide, N-bromo(or -iodo)phthalazinone, N-bromo(or -iodo)acetamide, N-bromo(or -iodo)acetanilide and α-bromo(or -iodo)diphenylmethane. Still further specific examples of the halogenating agent include $CoX_2$, $NiX_2$, $MgX_2$, $BaX_2$, RbX, CsX, $TeX_2$, $TeX_4$ and $AsX_3$. In these formulae, X is bromine or iodine.

The preferred amount of the silver halide component is in the range of from 0.001 to 0.5 mole per mole of the silver salt oxidizing agent (a). From the viewpoint of stability of raw image forming materials, a silver halide component including silver iodide and a silver halide-forming component capable of forming a silver halide component including silver iodide are preferred. From the viewpoint of sensitivity of dry image forming materials, a mixture or mixed crystals of silver iodide with silver chloride or silver bromide is preferred. In the case of the post-activation type dry image forming material, the halogenating agents mentioned before under (iii) to (vii) are preferred.

In the case of the post-activation type dry image forming material according to the present invention that may be spectrally sensitized, it is preferred that the silver halide component (c) or the silver halide component formed from the silver halide-forming component (c) include therein silver iodide. In order for the silver iodide to exert a sufficient effect for the purpose of the present invention, it is preferable that silver iodide be included in an amount of at least 30 mole % based on the silver halide component. The more preferable amount of silver iodide is at least 50 mole % based on the silver halide component. From the viewpoint of sensitivity of the image forming material, the silver halide component is desired to contain, besides silver iodide, at least 2 mole %, based on the silver halide component, of silver bromide and/or silver chloride, although the silver halide component may include only silver iodide, i.e. 100 mole % of silver iodide. Furthermore, from the viewpoint of stability of the raw image forming material, it is desirable that the silver halide component contain, besides silver iodide, silver bromide rather than silver chloride. Therefore, the most preferred silver halide component consists of silver iodide and silver bromide. In this case, silver iodide and silver bromide may be provided in the form of either a mixture thereof or mixed crystals thereof. The molar ratio of silver iodide to silver bromide may be preferably 30/70 to 98/2, more preferably 50/50 to 95/5. In the case of the post-activation type dry image forming material that may be spectrally sensitized, the more preferred amount of the silver halide component including silver iodide is 0.1 to 20 mole %, based on the amount of the organic silver salt oxidizing agent (a). The in situ preparation, as described before, of the silver halide component including silver iodide is preferred in which silver iodide and any other silver halide(s) are formed by the reaction between the long chain fatty acid silver salt (a) and the silver halide-forming component (c). In this case also, the preferred halogenating agents are those described before under (iii) to (vii). Of them, those under (iii) and (iv) are more preferred when the stability of raw dry image forming materials of the post-activation type is taken into consideration. From the viewpoint of sensitivity as well as stability of raw material, the preferred halogenating agents for forming silver iodide are iodine and N-iodosuccinimide. Complexes of iodine such as a complex of triphenyl phosphite and iodine and a complex of p-dioxane and iodine are also preferred. In the case of N-iodosuccinimide, it is preferred that a solution of N-iodosuccinimide in an alcohol such as methanol or ethanol, which has been previously prepared, be incorporated into an emulsion for the desired dry image forming material. From the viewpoint of sensitivity as well as stability of the raw image forming material, the preferred halogenating agents for forming silver bromide are N-bromosuccinimide, cobalt dibromide, nickel dibromide and α-bromodiphenylmethane. The amount, in equivalents, of the halogenating agent to be used may be equal to or more than the desired amount, in equivalents, of the silver halide component.

The toning agent (d) is employed in the present invention for developing a black color in the image areas of the imagewise-exposed material. Various toning agents known in the art can be employed. Examples of such toning agents include phthalazinone and phthalic anhydride (see U.S. Pat. No. 3,080,254); 2-pyrazolin-5-ones, cyclic imides, e.g., phthalimide and N-hydroxyphthalimide, and quinazolinones (see U.S. Pat. No. 3,846,136); mercapto compounds (see U.S. Pat. No. 3,832,186); oxazinediones (see U.S. Pat. No. 3,951,660); combinations of phthalic acid or phthalamic acid with imidazole (see U.S. Pat. No. 3,847,612); and combinations of phthalazine with an aromatic acid or its anhydride (see U.S. Pat. No. 4,123,282). The amount of the toning agent (d) is preferably in the range of 1 to 100 mole %, based on the organic silver salt oxidizing agent (a).

The lipophilic binder (e) to be used in the dry image forming material of the present invention is capable of dissolving in organic solvents. As the material of the binder (e), there can be mentioned, for example, polyvinyl butyral, polymethyl methacrylate, cellulose acetate, polyvinyl acetate, cellulose acetate propionate, cellulose acetate butyrate, polystyrene, polyvinyl formal and high impact acrylic resins having an Izod impact strength (notched) of at least 0.4 ft.lb/in as measured in accordance with ASTM D 256. Preferred are polyvinyl butyral, and high impact acrylic resins which are especially useful in the aforementioned preferred embodiment of the present invention. It is also preferred that polyvinyl butyral be used in a layer containing the components (a), (c) and (f), and that a high impact acrylic resin as mentioned above be used in a layer containing the component (b). These binder materials may be used either alone or in combination. In the case of the binder used in a layer containing the non-photosensitive organic silver salt oxidizing agent (a), it is preferred that the binder be used in such an amount that the weight ratio of the binder to the organic silver salt oxidizing agent is in the range of from about 0.1 to about 10.

The use of the component (f) constitutes the characteristic feature of the present invention, and greatly contributes to an improvement in storage stability of the raw dry image forming material according to the present invention. The component (f) is at least one compound selected from those compounds represented by the formulae (I) and (II) mentioned before. Compounds having either an alkyl group with 9 or more carbon atoms or an alkoxy group with 5 or more carbon atoms instead of R in the formula (I) or (II) are not usable because they have too poor a compatibility with the other components to exert a sufficient effect for the purpose of the present invention. In the formulae (I) and (II), R is preferably a hydrogen atom. The compounds of the formula (I) is preferred to those of the formula (II). In order to enable the component (f) to sufficiently interact with the organic silver salt oxidizing agent (a) to provide a sufficient effect for the purpose of the present invention, the compound (f) must be contained in a layer containing the component (a). The preferred amount of the component (f) is in the range of $1\times10^{-2}$ to $6\times10^{-1}$ mole, more preferably in the range of $3\times10^{-2}$ to $3\times10^{-1}$ mole, per mole of organic silver salt oxidizing agent (a). Specific examples of compounds usable as the component (f) include those represented by the following formulae.

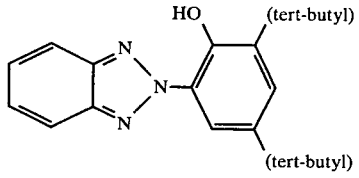

(f1)

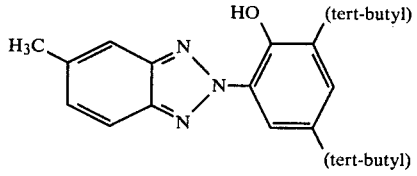

(f2)

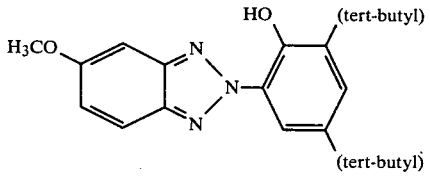

(f3)

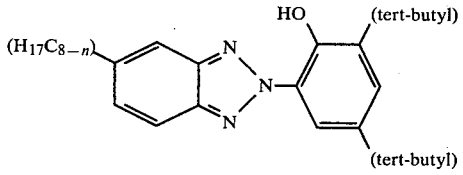

(f4)

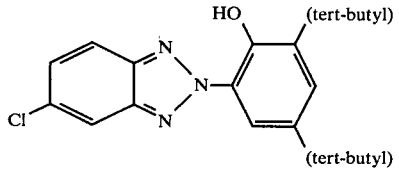

(f5)

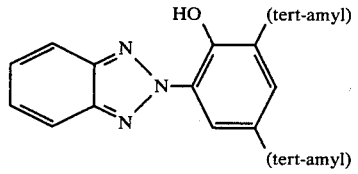

(f6)

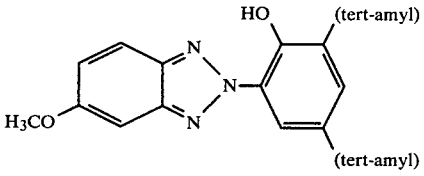

(f7)

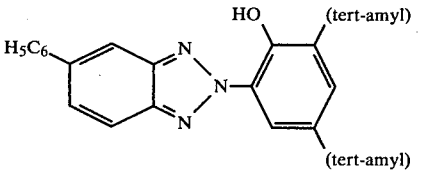

(f8)

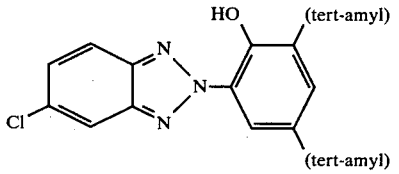

(f9)

-continued

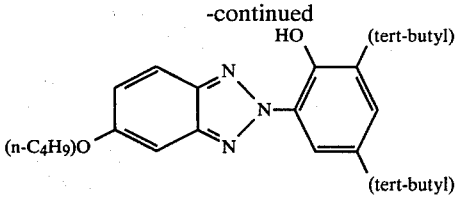

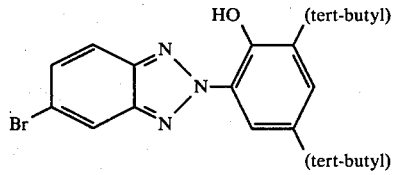

The high impact acrylic resin, which may be used as a binder material of the dry image forming material of the present invention, and the use of which is advantageous especially in the aforementioned preferred embodiment of the present invention, may be a blend of at least one rigid thermoplastic acrylic polymer and at least one rubber-elastic polymer, or at least one copolymer comprising rigidity-providing acrylic monomer units and rubber elasticity-providing monomer units or a combination thereof with at least one rigid thermoplastic acrylic polymer and/or at least one rubber-elastic polymer. The high impact acrylic resin has an Izod impact strength (notched) of at least 0.4 ft.lb/in, usually 0.5 to 25 ft.lb/in, most practically 0.5 to 5 ft.lb/in, as measured in accordance with ASTM D 256. The high impact acrylic resin preferably contains 0.5 to 300 parts by weight, more preferably 5 to 200 parts by weight, of the rubber-elastic polymer and/or rubber elasticity-providing monomer units per 100 parts by weight of the rigid thermoplastic acrylic polymer and/or rigidity-providing acrylic monomer units.

The rigid thermoplastic acrylic polymer, which preferably has a weight average molecular weight of 5,000 to 1,000,000, more preferably 10,000 to 500,000, may be an acrylic homopolymer of an unsubstituted or substituted $C_1$–$C_4$ alkyl, cyclohexyl, $C_6$–$C_{10}$ aryl, benzyl or tetrahydrofurfuryl ester of methacrylic acid or an acrylic copolymer comprising monomer units of at least one member selected from unsubstituted or substituted $C_1$–$C_6$ alkyl, $C_6$–$C_{10}$ aryl, benzyl or tetrahydrofurfuryl esters of methacrylic acid, and is desired to have a Rockwell hardness of M 75 to M 120, preferably M 80 to M 110. The acrylic copolymer may contain up to about 10% by weight of acrylic acid and/or methacrylic acid monomer units. The substituted alkyl, aryl, benzyl or tetrahydrofurfuryl group that may be contained in the above-mentioned esters of methacrylic acid may be one substituted with a halogen, nitro, amino, hydroxy or a $C_1$–$C_4$ alkoxy. Specific examples of the ester of methacrylic acid capable of forming the rigid thermoplastic acrylic polymer of either the homopolymer type or the copolymer type usable in the high impact acrylic resin of the blend type include methyl methacrylate, ethyl methacrylate, cyclohexyl methacrylate, tert-butyl methacrylate, benzyl methacrylate, tetrahydrofurfuryl methacrylate, phenyl methacrylate, p-bromophenyl methacrylate, $\alpha$-naphthyl methacrylate and $\beta$-naphthyl methacrylate.

As the rubber-elastic polymer that may be suitably used for blending with the rigid thermoplastic acrylic polymer or combining with the copolymer comprising rigidity-providing acrylic monomer units and rubber elasticity-providing monomer units to form the high impact acrylic resin, there can be mentioned polyurethanes, styrene-butadiene copolymers, ethylene-vinyl acetate copolymers, polyacrylates and the like. The rubber-elastic polymer is desired to have a glass transition temperature of at most 80° C., preferably −80° to 40° C., more preferably −60° to 10° C. Polyacrylates are most preferred as the rubber-elastic polymer. The rubber-elastic polyacrylates preferably comprise at least 5% by weight, more preferably at least 30% by weight, of monomer units of at least one unsubstituted or substituted $C_1$–$C_{22}$ alkyl ester of acrylic acid, or at least 80% by weight, more preferably at least 90% by weight, of monomer units of at least one unsubstituted or substituted $C_7$–$C_{22}$ alkyl ester of methacrylic acid (the above-specified lower limit of amount of the monomer units of said at least one alkyl ester of methacrylic acid can be lowered when said at least one alkyl ester of methacrylic acid is used in combination with said at least one alkyl ester of acrylic acid). The substituted alkyl group that may be contained in the above-mentioned ester of acrylic acid or methacrylic acid may be one substituted with a halogen, amino, hydroxy, a $C_1$–$C_4$ alkoxy or a di($C_1$–$C_4$ alkyl)amino. Specific examples of the unsubstituted or substituted $C_1$–$C_{22}$ alkyl ester of acrylic acid include methyl acrylate, propyl acrylate, ethyl acrylate, n-butyl acrylate, isobutyl acrylate, 2-hydroxypropyl acrylate, diethylaminoethyl acrylate and dimethylaminoethyl acrylate. Specific examples of the unsubstituted or substituted $C_7$–$C_{22}$ alkyl ester of methacrylic acid include 2-ethylhexyl methacrylate, lauryl methacrylate, tridecyl methacrylate and stearyl methacrylate. The rubber-elastic polyacrylate may contain other monomer units selected from monomer units of at least one unsubstituted or substituted $C_1$–$C_6$ alkyl, $C_6$–$C_{10}$ aryl, benzyl or tetrahydrofurfuryl ester of methacrylic acid as mentioned before, styrene monomer units, ethylvinylbenzene monomer units, acrylonitrile monomer units, vinyl acetate monomer units, acrylic acid monomer units, maleic acid or anhydride monomer units and the like. It is preferred that the rubber-elastic polyacrylate be partially crosslinked by incorporating thereinto up to 20% by weight, more preferably up to 5% by weight, of monomer units of at least one crosslinkable monomer selected from divinylbenzene, ethylene glycol diacrylate, ethylene glycol dimethacrylate, diethylene glycol diacrylate, diethylene glycol dimethacrylate, glycerin triacrylate, glycerin trimethacrylate, dipropylene glycol diacrylate, dipropylene glycol dimethacrylate, butylene glycol diacrylate, butylene glycol dimethacrylate, diallyl maleate, triallyl cyanurate and the like.

The high impact acrylic resin of the copolymer type, which preferably has a weight average molecular weight of 5,000 to 1,000,000, more preferably 10,000 to 500,000, may comprise rigidity-providing monomer units of at least one ester of methacrylic acid as mentioned before as being capable of forming the rigid thermoplastic acrylic polymer of the homopolymer type and 0.5 to 300% by weight, based on the rigidity-providing monomer units, of rubber elasticity- or flexibility-providing monomer units of at least one member selected from unsubstituted or substituted $C_1$–$C_{22}$ alkyl esters of acrylic acid and unsubstituted or substituted $C_7$–$C_{22}$ alkyl esters of methacrylic acid which are mentioned before as being capable of forming the rubber-elastic polyacrylate.

The high impact acrylic resin may also be one prepared by polymerizing, in the presence of at least one copolymer comprising rigidity-providing monomer units and flexibility-providing monomer units of the kinds as mentioned above with respect to the high impact acrylic resin of the copolymer type and/or at least one rubber-elastic polymer, at least one ester of methacrylic acid as mentioned before as being capable of forming a rigid thermoplastic acrylic polymer of the homopolymer type. In this case, the high impact acrylic resin may comprise a block or graft copolymer although there remains a possibility that the resin is a mere blend of said at least one copolymer and/or said at least one rubber-elastic polymer with a polymer formed from said at least one ester of methacrylic acid.

A monomer or monomers capable of copolymerizing with an ester of methacrylic acid, which may be selected, for example, from vinyl acetate, styrene, acrylonitrile, acrylic acid and maleic acid or anhydride, may be used for partial replacement thereof for the ester(s) of methacrylic acid mentioned before as being capable of forming a rigid thermoplastic acrylic polymer.

The high impact acrylic resin, which may be either of the blend type, or of the copolymer type or the combination type thereof as described hereinbefore, is desired to comprise at least 50 parts by weight, preferably 80 parts by weight, of the acrylic and/or methacrylic ester component per 100 parts by weight of the acrylic resin. Here, the term "acrylic and/or methacrylic ester component" is intended to indicate all of monomer units of the acrylic and/or methacrylic ester type contained in the polymer or polymers constituting the acrylic resin.

For the measurement of a weight average molecular weight, there may be adopted a gel permeation chromatography (GPC) method using, as standard samples, polystyrenes manufactured by Pressure Chemical Co., U.S.A and as an apparatus, WATERS 200 manufactured by Japan-Waters Co., Japan.

Examples of the method for preparing the high impact acrylic resin that may be used in the dry image forming material of the present invention together with the recipe of the acrylic resin are described in U.S. Pat. No. 3,793,402, No. 4,180,529, No. 4,052,525 and No. 3,681,475.

If desired, additives of various kinds such as a lubricant, an anti-oxidizing agent, an ultraviolet absorber and a colorant may be added to the high impact acrylic resin.

The oxidizing agent for free silver that may be used as the component (g) in the post-activation type dry image forming material according to the present invention, which is preferably spectrally sensitized, has a capacity of oxidizing free silver produced during the storage of the material, thereby contributing to improving the stability of raw material. As examples of the free silver-oxidizing agent (g), there can be mentioned compounds of divalent mercury ($Hg^{++}$), compounds of trivalent iron ($Fe^{+++}$), compounds of trivalent cobalt ($Co^{+++}$), compounds of divalent palladium ($Pd^{++}$) and sulfinic acid compounds. As examples of the compounds of divalent mercury, there can be mentioned mercuric salts of aliphatic carboxylic acids such as mercuric acetate and mercuric behenate; mercuric salts of aromatic carboxylic acids such as mercuric benzoate, mercuric m-methylbenzoate and mercuric acetamidobenzoate; mercuric halides such as mercuric bromide and mercuric iodide; mercuri-benzotriazole; and mercuri-phthalazinone. Preferred are mercuric acetate, mercuric bromide and mercuric iodide. As examples of the compounds of trivalent iron, there can be mentioned a complex of trivalent iron and acetylacetone and a complex of trivalent iron and bipyridyl. As examples of the compounds of trivalent cobalt, there can be mentioned a complex of trivalent cobalt and acetylacetone and a complex of trivalent cobalt and o-phenanthroline, and cobaltic halides such as cobaltic iodide and cobaltic bromide. Examples of the compounds of divalent palladium include a complex of divalent palladium and acetylacetone, and palladium (II) halides such as palladium (II) iodide and palladium (II) bromide. As examples of the sulfinic acid compound, there can be mentioned n-octylsulfinic acid and p-toluenesulfinic acid. As the component (g), the compounds of divalent mercury are most preferred. The preferred amount of the component (g) is in the range of from 0.01 to 10 mole % based on the organic silver salt oxidizing agent (a).

It is to be noted that the component (g) may also be used as an anti-foggant in the case of the dry image forming material according to the present invention which is even of the type other than the post-activation type of material that may be spectrally sensitized.

In the case of the post-activation type dry image forming material according to the present invention which is preferably spectrally sensitized, the free silver-oxidizing agent (g) is reduced by serving to oxidize the free silver produced during the storage of the raw image forming material into the original silver halide. The thus reduced free silver-oxidizing agent, in turn, is oxidized, under lighting conditions, by the action of the photoreactive halogeno oxidizing agent (h), whereby it is effectively returned to the original state in which the component (g) has a capacity of oxidizing free silver. The photoreactive halogeno oxidizing agent (h) that may advantageously be used in combination with the component (g) especially in the case of the post-activation dry image forming material which may advantageously be spectrally sensitized is such a halogeno compounds as can generate free radicals of halogen upon light exposure. Preferred examples of such a halogeno compound are halogenated organic compounds having bromine- and/or iodine-carbon linkages.

Whether or not a given halogen compound is suitable for use as the component (h) in the present invention can be determined, for example, by the following photoreaction test.

1 Mole of silver behenate [suitable as the silver behenate is one which has been synthesized in a mixed solvent (1:5–5:1 by volume) of water and at least one water-soluble or partially water-soluble alcohol having 3 to 8 carbon atoms], 450 g of polyvinyl butyral and 0.25 mole of said given halogeno compound for use as the "photoreactive halogeno oxidizing agent" are dissolved into a mixed solvent (2:1 by weight) of methyl ethyl ketone and toluene, and then formed into a film according to an ordinary casting method.

The film thus formed is tested with respect to the following two requirements. When the film satisfies both of the requirements, the halogeno compound (for use as the photoreactive oxidizing agent) employed is suitable for the purpose of the present invention.

Requirement 1: when the film is examined by X-ray diffractometry, the peak due to silver bromide ($2\theta=31.0°$) or the peak due to silver iodide ($2\theta=23.7°$) should not substantially be observed [the relative intensity of said peak is less than about 10 when the relative intensity of the peak due to silver behenate ($2\theta=12.1°$) is defined as 100].

Requirement 2: subsequently, the film is irradiated with a light (0.5 mW/cm$^2$) emitted from a black lamp in an atmosphere having a temperature of 50° C. and a relative humidity of 80% for 2 hours, and then examined by X-ray diffractometry again. The peak due to silver bromide ($2\theta=31.0°$) or the peak due to silver iodide ($2\theta=23.7°$) should be substantially observed [the relative intensity of said peak is about 10 or more when the relative intensity of the peak due to silver behenate ($2\theta=12.1°$) is defined as 100].

In the above test, the values of $2\theta$ are those of diffraction peaks obtained by using $CuK_\alpha$ line. In the test, as the apparatus for X-ray diffractometry is used an apparatus of Rotor Unit type (RU-200 PL type) manufactured and sold by Rigaku Denki Kabushiki Kaisha, Japan.

Specific examples of halogeno compounds capable of being used as the photoreactive halogeno oxidizing agent (h) include α,α,α',α'-tetrabromo-o-xylene, α,α,α',α'-tetrabromo-m-xylene, ethyl α,α,α-tribromoacetate, α,α,α-tribromoacetophenone, α,α,α-tribromo-p-bromotoluene, 1,1,1,-tribromo-2,2-diphenylethane, tetrabromomethane, 2,2,2,-tribromoethanol, 2,2,2-tribromoethylcyclohexyl carbamate, 2,2,2-tribromoethylphenyl carbamate, 2,2,2-tribromoethyl benzoate, 2,2,2-tribromoethyl ethylcarbamate, 2-methyl-1,1,1-tribromo-2-propanol, bis(2,2,2-tribromoethoxy)-diphenylmethane, 2,2,2-tribromoethyl stearate, 2,2,2-tribromoethyl-2-fuorate, bis(2,2,2-tribromoethyl) succinate, 2,2,2-tribromoethyl phenylsulfonate, 2,2,2-tribromoethoxytrimethyl silane, 2,2,2-tribromo-1-phenylethanol, 2,2,2-tribromoethyldiphenyl phosphate, 1,2-diiodoethane and iodoform. They may be employed either alone or in combination. Of them, the bromo compounds are preferred since they give little coloring and improved stability to the resulting raw dry image forming material. Especially preferred are α,α,α',α'-tetrabromo-o-xylene, α,α,α',α'-tetrabromo-m-xylene, ethyl α,α,α-tribromoacetate, α,α,α-tribromo-p-bromotoluene, α,α,α-tribromoacetophenone, 1,1,1-tribromo-2,2-diphenylethane and 2,2,2-tribromoethanol. Most preferred are α,α,α',α'-tetrabromo-o-xylene and α,α,α',α'-tetrabromo-m-xylene. The amount of the photoreactive halogeno oxidizing agent (h) is preferably 2.5 to 40 mole %, based on the organic silver salt oxidizing agent (a).

It is desirable in the present invention to employ the photoreactive halogeno oxidizing agent (h) in even the post-activation type dry image forming material not spectrally sensitized, from the viewpoint of storage stability of raw material.

The spectral sensitizing dye (i) that may advantageously be used in the post-activation dry image forming material according to the present invention consists of at least one compound selected from those compounds represented by the formulae (III), (IV), (V) and (VI) mentioned before, in which A is preferably a straight chain propylene group for the purpose of the present invention. The preferred amount of the component (i) is 0.001 to 1 mole % based on the organic silver oxidizing agent (a). The spectral sensitizing dye (i) may also be, in some cases, used in the already photosensitive type dry image forming material according to the present invention. Specific examples of the spectral sensitizing dye compounds usable as the component (i) include those represented by the following formulae.

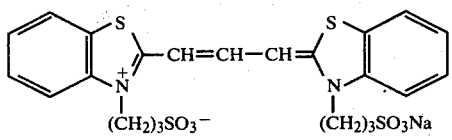
(1)

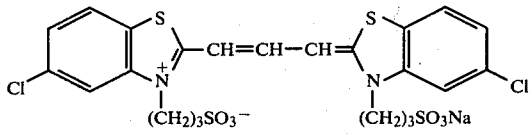
(2)

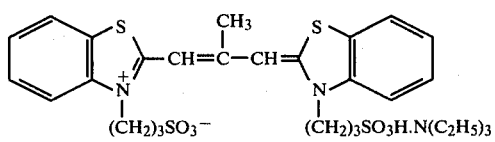
(3)

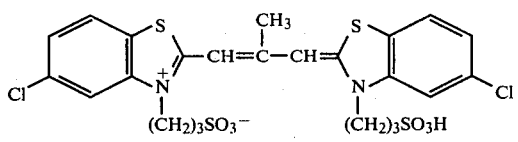
(4)

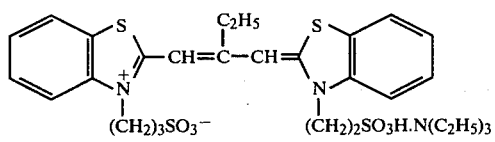
(5)

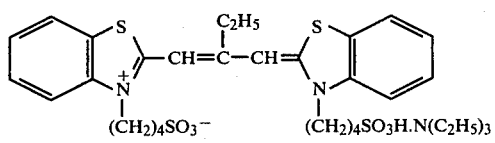
(6)

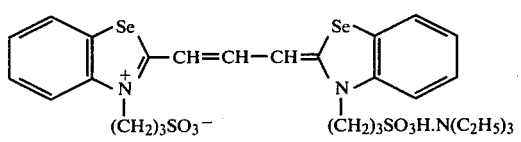
(7)

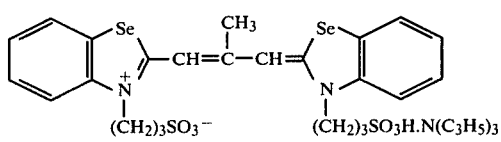
(8)

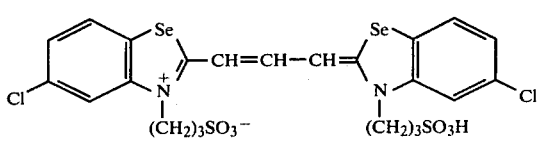
(9)

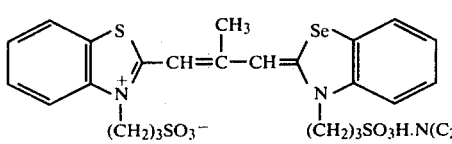
(10)

-continued
(11)
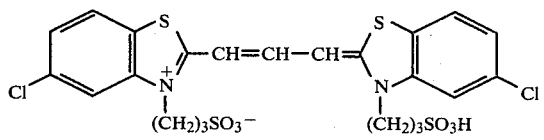
(12)
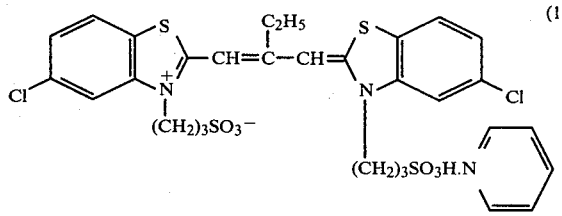
(13)
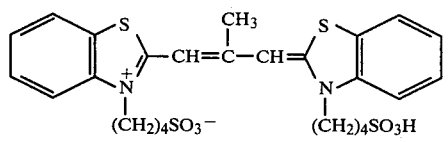
(14)
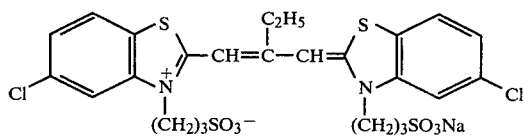
(15)
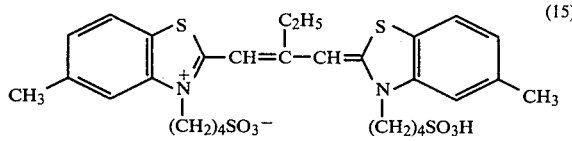
(16)
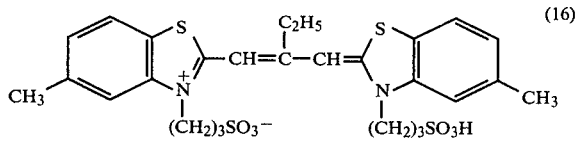
(17)
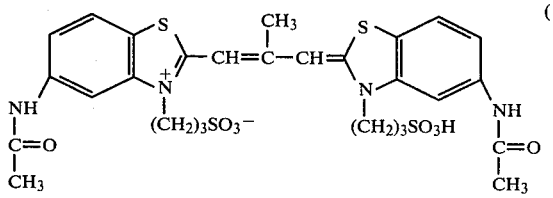
(18)
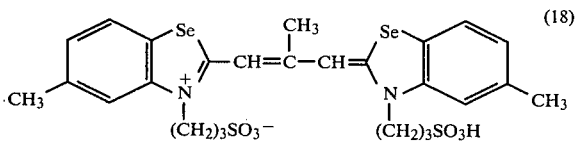
(19)
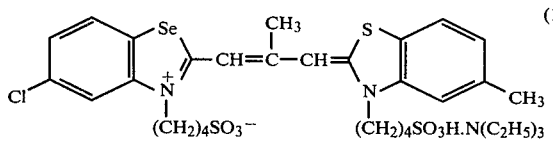
(20)
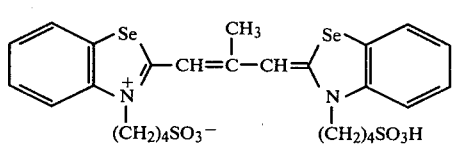
-continued
(21)
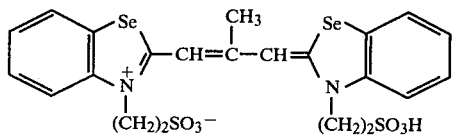
(22)
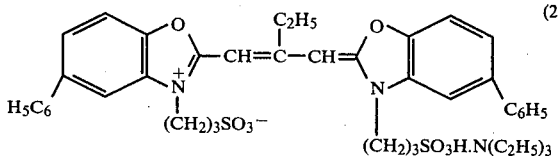
(23)
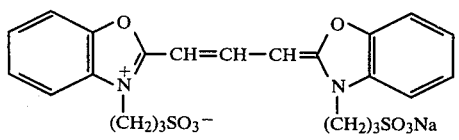
(24)
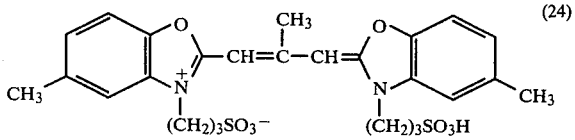
(25)
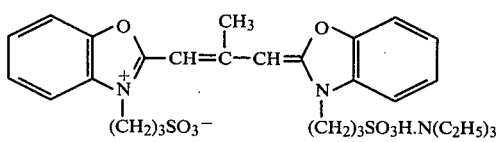
(26)
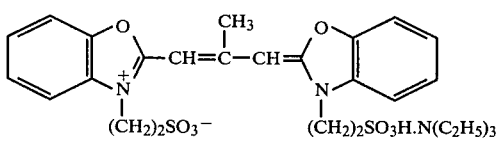
(27)
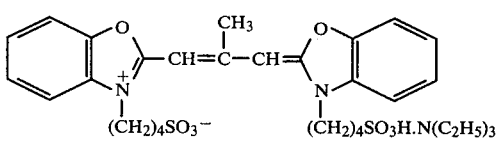
(28)
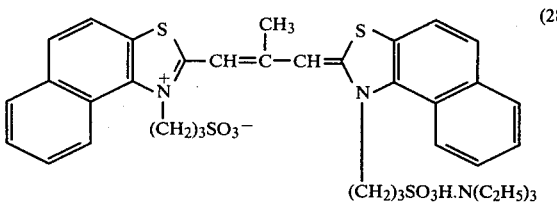
(29)
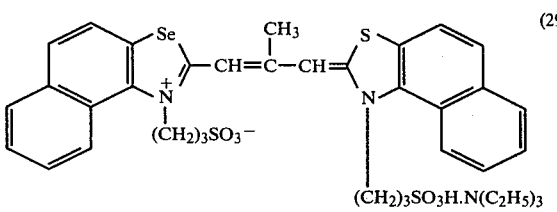

-continued
(30)
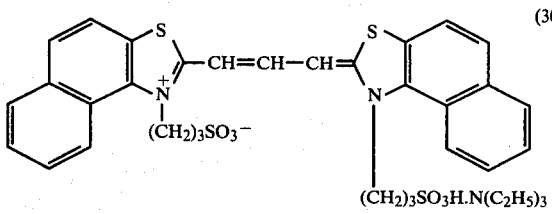
(31)
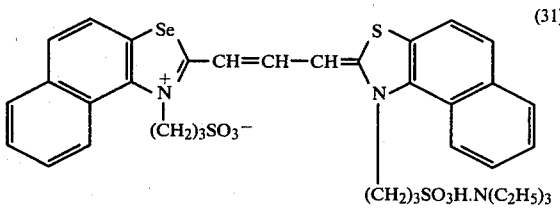
(32)
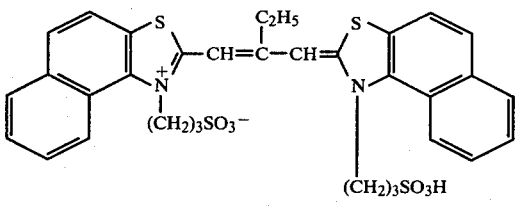
(33)
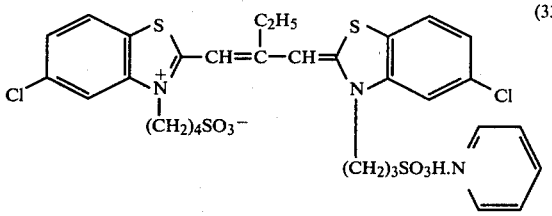
(34)
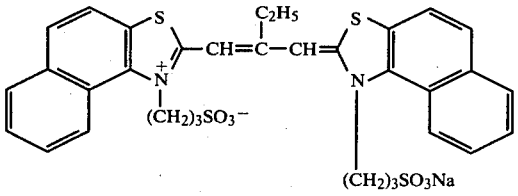
(35)
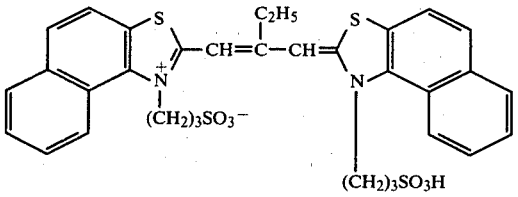
(36)
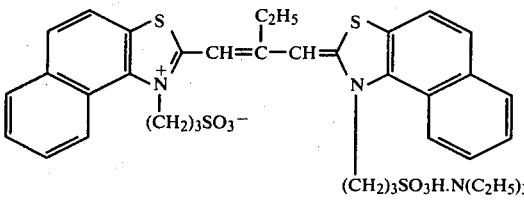
-continued
(37)
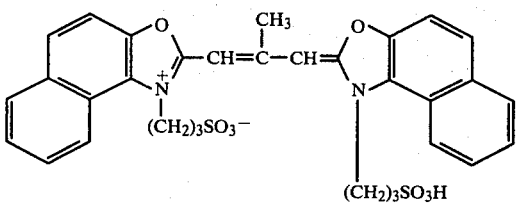
(38)
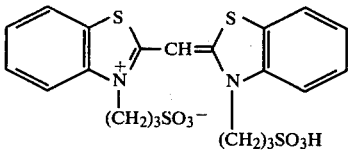
(39)
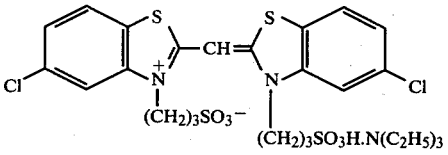
(40)
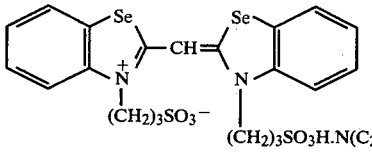
(41)
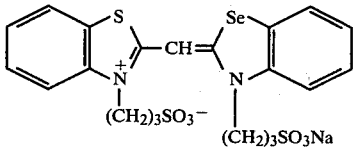
(42)
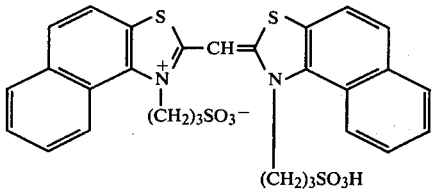
(43)
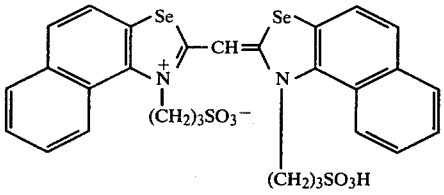
(44)
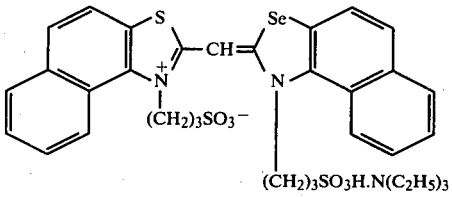

-continued (45)

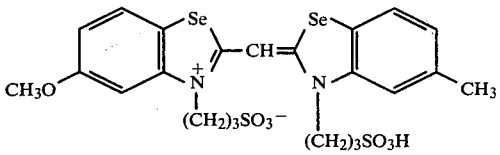

(46)

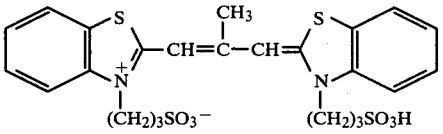

(47)

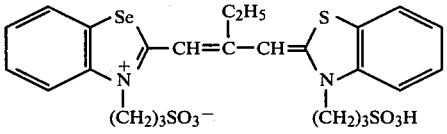

(48)

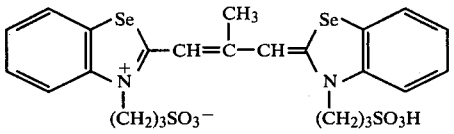

(49)

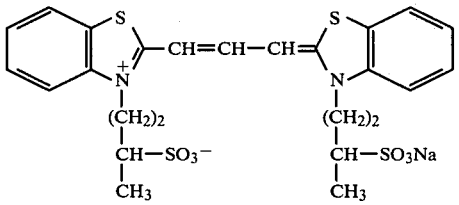

(50)

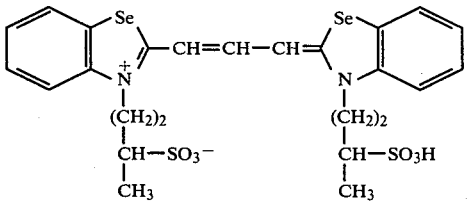

(51)

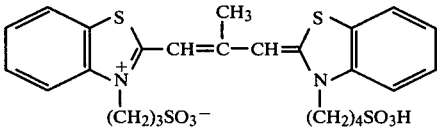

(52)

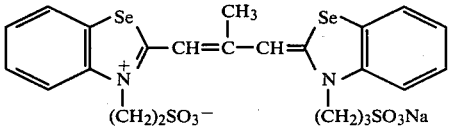

(53)

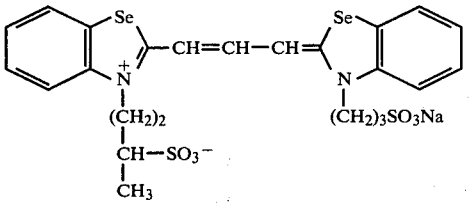

If desired, the dry image forming material of the present invention may further comprise a chemical sensitizer. Among chemical sensitizers which improve the sensitivity of the dry image forming material of the present invention, those liable to spoil greatly the storage stability of the dry image forming material prior to the use thereof are not preferred. As chemical sensitizers which substantially improve the sensitivity of but not substantially spoil the storage stability of the dry image forming material of the present invention, there can be mentioned, for example, amide compounds as disclosed in Japanese patent application Laid-Open Specification No. 7914/1976, e.g., 1-methyl-2-pyrrolidone; quinoline compounds as disclosed in Deutsche Offenlegungsschrift No. 2,845,187 and represented by the following general formula:

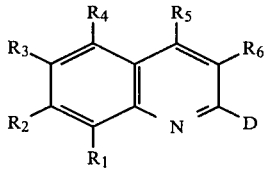

wherein $R_1$, $R_2$, $R_3$, $R_4$ $R_5$ and $R_6$, each independently, is a hydrogen atom, an aryl group selected from phenyl and naphthyl groups unsubstituted or substituted with methyl, methoxy or halogen, a $C_1$–$C_{10}$ straight or branched chain alkyl group, a $C_1$–$C_4$ alkoxyl group, an aralkyl group selected from benzyl and phenethyl groups unsubstituted or substituted with methyl, methoxy or halogen, a hydroxyl group, a cyano group, a carboxyl group, a $C_2$–$C_5$ alkoxycarbonyl group, a nitro group, an amino group or a carbamoyl group, and D is a hydrogen atom, a hydroxyl group or an amino group; and 3-pyrazolin-5-one compounds as disclosed in Deutshe Offenlegungsschrift No. 2,934,751 and represented by the following formula:

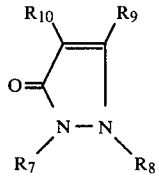

wherein $R_7$ is a hydrogen atom, a $C_1$–$C_5$ straight or branched chain alkyl group, an unsubstituted or substituted phenyl group or an unsubstituted or substituted $C_3$–$C_8$ cycloalkyl group, $R_8$ is a $C_1$–$C_5$ straight or branched chain alkyl group, an unsubstituted or substituted phenyl group or an unsubstituted or substituted $C_3$–$C_8$ cycloalkyl group, and $R_9$ and $R_{10}$ are the same or different and each represents a hydrogen atom, a $C_1$–$C_5$ straight or branched chain alkyl group, an unsubstituted or substituted phenyl group or an unsubstituted or substituted phenylalkyl group having a $C_1$–$C_5$ straight or branched chain alkyl moiety. They may be used either alone or in combination preferably in an amount of 5 to 50 mole %, based on the organic silver salt oxidizing agent (a). Specific examples of 3-pyrazolin-5-one compounds include 2-phenyl-3-pyrazolin-5-one, 1-(p-iodophenyl)-2,3-dimethyl-3-pyrazolin-5-one, 2,3,4-triphenyl-3-pyrazolin-5-one, 1-phenyl-2,3-dimethyl-3-pyrazolin-5-one, 1,3-diethyl-2-phenyl-3-pyrazolin-5-one, 2,3-dimethyl-1-ethyl-4-isopropyl-3-pyrazolin-5-one, 2-o-tolyl-3-methyl-4-ethyl-3-pyrazolin-5-one, 2-cyclohexyl- 3-pyrazolin-5-one, 2-methyl-1,3-diphenyl-3-pyrazolin-5-one and 1-cyclohexyl-2,3-dimethyl-3-pyrazolin-5-one.

The preferred method of preparing the dry image forming material of this invention is described by way of example as follows. An organic silver salt oxidizing agent is dispersed in a binder-forming polymer solution by means of a ball mill, a homogenizer, a mixer, a sand mill or the like. To the resulting dispersion are added the other essential components and optionally various additives. The composition thus obtained is applied onto a support such as a plastic film, a glass plate, a paper or a metal plate, followed by drying, to prepare a dry image forming material. As the plastic film, there can be mentioned a polyethylene film, a cellulose acetate film, a polyethylene terephthalate film, a polyamide film, a polypropylene film and the like. The dry thickness of the coating as the image forming layer may be 1 to 100μ, preferably 3 to 20μ. The essential components of the image forming material of the present invention may be applied either in one layer as described above, or in two or more separate but contiguous layers. For the purposes of the protection of the heat-developable image forming layer and so on, a top coat may be provided. The material for the top coat may be chosen from among the binder materials as mentioned hereinbefore. In the case of the post-activation type dry image forming material, the preparation, application to a support and subsequent drying of a composition(s) containing the essential components may be carried out even in a light room, but preferably at a temperature of 50° C. or less.

When the sheet material so prepared is of the already photosensitive type, the material can form thereon a visible image when subjected to imagewise exposure to light and heat development which is usually conducted at a temperature of about 90° to 150° C. for about 1 to 30 seconds.

When the sheet material is of the post-activation type, the material does not lose an image forming capacity even if stored under normal lighting conditions and it can be handled in a light room. When a given area of this sheet material is heated in the dark, this area is rendered photosensitive. This preliminary heating is preferably carried out at a temperature of about 90° to about 130° C. As the heating temperature is elevated, the heating time may be proportionally shortened. When the area rendered photosensitive by heating is exposed imagewise to light and then heat-developed, a visible image is obtained. It is preferred that the heat development be carried out at a temperature of about 90° to about 150° C. The heating time at the step of either preliminary heating or heat development may be controlled within the range of from about 1 to about 30 seconds. When the preliminary heating for rendering the material photosensitive and the heat development are conducted at the same temperature, the time for the heat development is generally equal to or longer than the time for the preliminary heating. In the image forming material of this invention, a visible image can be recorded selectively on a given area, and updated information may be additionally recorded on other area according to need. Furthermore, the image forming material of this invention can form thereon an image by photographing even a colored manuscript.

The following Examples illustrate the present invention in more detail but should not be construed as limiting the scope of the invention.

In the following Examples and Comparative Examples, the relative sensitivity, retention of sensitivity and $O.D._{0.4}$ of dry image forming material are evaluated as follows.

The sensitivity of dry image forming material is defined to be expressed by the reciprocal of amount of exposure light required for giving an optical density (O.D.) 0.6 higher than the minimum optical density (O.D. min) of dry image forming material. Relative sensitivity (R.S.) is given herein in terms of a proportion of the sensitivity of dry image forming material relative to the sensitivity of a given dry image forming material whose relative sensitivity is defined as 100.

The retention of sensitivity is given herein in terms of a proportion of sensitivity of dry image forming material subjected to an accelerated deterioration test relative to sensitivity of the corresponding dry image forming material not subjected to the accelerated deterioration test.

The $O.D._{0.4}$ is defined, in the photographic characteristic curve of an imaged material, to be an optical density (O.D.) obtained by the amount of exposure light 0.4 lower, in terms of logarithmic value, than that required for giving an optical density of 1.0. The $O.D._{0.4}$ is a yardstick of the sharpness of an image. The sharper the image and, hence, the higher the quality of the image, the lower the $O.D._{0.4}$.

EXAMPLES 1 TO 4 AND COMPARATIVE EXAMPLES 1 TO 6

To 20 g of a mixed solvent of toluene and methyl ethyl ketone (mixing weight ratio = 1:2) was added 3 g of silver behenate, and the mixture was ball-milled for about 18 hours to obtain a homogeneous silver behenate suspension.

A silver behenate emulsion having a recipe [A] as shown below were prepared and uniformly applied onto a 100μ-thick polyethylene terephthalate film at an orifice of 100μ, and dried by air heated at 80° C. for 5 minutes to form a first coating layer. A reducing agent-containing solution having a recipe [B] as shown below was uniformly applied as a second coating layer onto the first coating layer at an orifice of 75μ, and dried by air heated at 80° C. for 5 minutes to obtain an already photosensitive type dry image forming material having a total coating layer thickness of about 12μ. The preparation of the dry image forming material was carried out in the dark.

| | |
|---|---|
| Recipe [A] | |
| Silver behenate suspension | 1.5 g |
| 10 Weight % solution of polyvinyl butyral in methyl ethyl ketone | 2.0 g |
| Tetraethylammonium bromide | 12 mg |
| Solution of 10 mg of mercuric acetate in 3 cc of ethanol | 0.15 cc |
| 1-Methyl-2-pyrrolidone | 30 mg |
| 2-(2'-Hydroxyphenyl)benzotriazole compound(s) as indicated in Table 1 (according to the present invention) | 35 mg |
| Recipe [B] | |
| Cellulose acetate | 6.3 g |
| 2,2'-Methylenebis(4-methyl-6-tert-butylphenol) | 3.5 g |
| Phthalazinone | 0.9 g |
| Acetone | 83 g |

A comparative dry image forming material was prepared in substantially the same manner as described above except that the use of the 2-(2'-hydroxyphenyl)-benzotriazole compound was omitted, or that a comparative compound as indicated in Table 1 was used instead of the 2-(2'-hydroxyphenyl)benzotriazole compound.

A piece of each dry image forming material was, in a dark room, exposed for $\frac{1}{8}$ second through a mask film closely contacted with the material to light emitted from a 500-watt Toshiba Photoreflector Lamp (trade name of a tungsten lamp manufactured by Tokyo Shibaura Electric Company Ltd., Japan), and then heated for 4 seconds on a hot plate maintained at 120° C. in a dark room to effect heat development.

Another piece of each dry image forming material was subjected to an accelerated deterioration test which was carried out by allowing the material to stand in a dark room at 50° C. and at a relative humidity of 80% for 3 days. The deteriorated material was subjected to the same image formation as described above.

The optical densities of the imaged materials respectively derived from the materials before and after subjected to the accelerated deterioration test were measured. The results evaluated in terms of fogging, relative sensitivity and retention of sensitivity are shown in Table 1, in which (f1), (f2), (f6) and (f7) indicate the aforementioned 2-(2'-hydroxyphenyl)benzotriazole compounds listed under such numbers (such indications used hereinafter have the same meanings), and in which the standard material with a relative sensitivity of 100 is of Comparative Example 1.

TABLE 1

| Run No. | 2-(2'-Hydroxyphenyl)-benzotriazole Compound or Comparative Compound | Before Accelerated Deterioration | | After Accelerated Deterioration | |
|---|---|---|---|---|---|
| | | Fogging (O.D. min) | Relative Sensitivity | Fogging (O.D. min) | Retention of Sensitivity (%) |
| Example 1 | (f1) | 0.07 | 96 | 0.12 | 92 |
| Example 2 | (f2) | 0.07 | 91 | 0.13 | 88 |
| Example 3 | (f6) | 0.07 | 92 | 0.14 | 89 |
| Example 4 | (f3) + (f7)[5/5 by weight] | 0.07 | 90 | 0.15 | 87 |
| Comparative Example 1 | none | 0.07 | 100 | 0.72 | — |
| Comparative Example 2 | (C1) | 0.10 | 0.1 | 0.89 | — |
| Comparative Example 3 | (C2) | 0.09 | 0.1 | 0.37 | — |
| Comparative Example 4 | (C3) | 0.07 | 46 | 0.62 | 30 |
| Comparative Example 5 | (C4) | 0.07 | 58 | 0.58 | 35 |
| Comparative Example 6 | (C5) | 0.07 | 66 | 0.51 | 39 |

The comparative compounds (C1) to (C5) used herein are mentioned below.

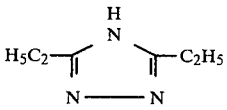
(C1)

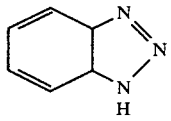
(C2)

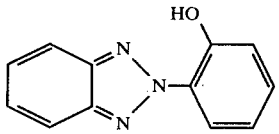
(C3)

-continued

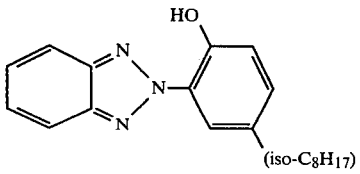
(C4)

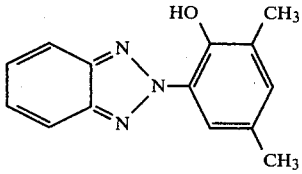
(C5)

As is apparent from the results shown in Table B 1, the 2-(2'-hydroxyphenyl)benzotriazole compounds (f1), (f2), (f6) and (f7) used in the dry image forming materials according to the present invention are by far superior in storage stability-improving effect to the compounds (C1) to (C5) used in the comparative dry image forming materials.

A dry image forming material was prepared in substantially the same manner as in each of Examples 1 to 4 and Comparative Examples 1 to 6 except that 11 mg of silver bromide previously prepared was used instead of 12 mg of tetraethylammonium bromide. With respect to each dry image forming material, the results evaluated in terms of fogging, relative sensitivity and retention of sensitivity were substantially the same as those obtained with respect to the dry image forming material prepared in the corresponding Example or Comparative Example.

EXAMPLES 5 TO 7 AND COMPARATIVE EXAMPLES 7 TO 10

A homogeneous silver laurate suspension was prepared in the same manner as in the preparation of the silver behenate suspension in Examples 1 to 4 and Comparative Examples 1 to 6. P An already photosensitive type dry image forming material was prepared in substantially the same manner as in Examples 1 to 4 except that recipes [C] and [D] were employed instead of the recipes [A] and [B], respectively.

| Recipe [C] | |
|---|---|
| Silver laurate suspension | 1.5 g |
| 10 Weight % solution of polyvinyl butyral in methyl ethyl ketone | 2.0 g |
| Calcium bromide | 12 mg |
| Solution of 10 mg of mercuric bromide in 3 cc of methanol | 0.15 cc |
| 1-Methyl-2-pyrrolidone | 30 mg |
| 2-(2'-Hydroxyphenyl)benzotriazole compound as indicated in Table 2 (according to the present invention) | 35 mg |
| **Recipe [D]** | |
| Cellulose acetate | 6.3 g |
| Phthalazinone | 0.9 g |
| 1,1-Bis(2-hydroxy-3-tert-butyl-5-methylphenyl)pentane | 3.5 g |
| Acetone | 83 g |

A comparative dry image forming material was prepared in substantially the same manner as described above except that the use of the 2-(2'-hydroxyphenyl)-benzotriazole compound was omitted, or that a comparative compound as indicated in Table 2 was used instead of the 2-(2'-hydroxyphenyl)benzotriazole compound.

A piece of each dry image forming material was subjected to the same image formation as in Examples 1 to 4 and Comparative Examples 1 to 6. Another piece of each dry image forming material was subjected to the same accelerated deterioration test as in Examples 1 to 4 and Comparative Examples 1 to 6, are subjected to the same image formation as in Examples 1 to 4 and Comparative Examples 1 to 6.

The relative sensitivity, fogging and retention of sensitivity of the dry image forming material were examined, and were found to be as shown in Table 2, in which the standard material with a relative sensitivity of 100 is of Comparative Example 7.

TABLE 2

| Run No. | 2-(2'-Hydroxyphenyl)-benzotriazole Compound or Comparative Compound | Before Accelerated Deterioration | | After Accelerated Deterioration | |
|---|---|---|---|---|---|
| | | Fogging (O.D. min) | Relative Sensitivity | Fogging (O.D. min) | Retention of Sensitivity (%) |
| Example 5 | (f3) | 0.07 | 92 | 0.12 | 89 |
| Example 6 | (f5) | 0.07 | 94 | 0.13 | 90 |
| Example 7 | (f8) | 0.07 | 89 | 0.16 | 85 |
| Comparative Example 7 | none | 0.07 | 100 | 0.81 | — |
| Comparative Example 8 | (C5) | 0.07 | 70 | 0.41 | 30 |
| Comparative Example 9 | (C6) | 0.07 | 73 | 0.38 | 28 |
| Comparative Example 10 | (C7) | 0.07 | 77 | 0.30 | 49 |

The comparative compounds (C6) and (C7) used herein are mentioned below.

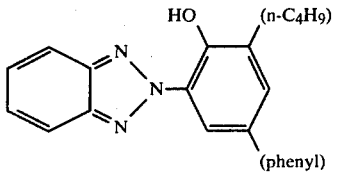

-continued

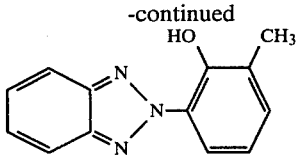

(C7)

As is apparent from the results shown in Table 2, the 2-(2'-hydroxyphenyl)benzotriazole compounds (f3), (f5) and (f8) are very effective for improving the storage stability of raw dry image forming materials.

EXAMPLES 8 TO 10 AND COMPARATIVE EXAMPLES 11 TO 15

A silver behenate emulsion having a recipe [E] as shown below, in which the silver behenate suspension was prepared in the same manner as in Examples 1 to 4 and Comparative Examples 1 to 6 (the "silver behenate suspension" appearing hereinafter was the same as prepared in Examples 1 to 4 and Comparative Examples 1 to 6), was prepared at room temperature (about 20° C.). The silver behenate emulsion was uniformly applied onto a 100μ-thick polyethylene terephthelate film at an orifice of 100μ, and air-dried at room temperature (about 20° C.) for 2 hours to form a first coating layer. A reducing agent-containing composition having a recipe [F] as shown below was uniformly applied as a second coating layer onto the first coating layer at an orifice of 75μ, and air-dried at room temperature (about 20° C.) for 5 hours to obtain a post-activation type dry image forming material having a total coating layer thickness of about 12μ. The preparation of the dry image forming material was conducted in a light room.

| Recipe [E] | |
|---|---|
| Silver behenate suspension | 1.5 g |
| 10 Weight % solution of polyvinyl butyral in methyl ethyl ketone | 2.0 g |
| Solution of 100 mg of mercuric acetate in 3 cc of ethanol | 0.15 cc |
| Ethyl α,α,α-tribromoacetate | 30 mg |
| N—Iodosuccinimide | 12 mg |
| Solution of 100 mg of cobalt bromide in 1 cc of methanol | 0.15 cc |
| 2-(2'-Hydroxyphenyl)benzotriozole compound as indicated in Table 3 (according to the present invention) | 35 mg |
| Quinoline | 30 mg |
| **Recipe [F]** | |
| Cellulose acetate | 6.3 g |
| Phthalazinone | 0.9 g |
| 2,2'-Methylenebis(4-ethyl-6-tert-butylphenol) | 3.5 g |

-continued

| | |
|---|---|
| Acetone | 83 g |

A comparative dry image forming material was prepared in substantially the same manner as described above except that the use of the 2-(2'-hydroxyphenyl)-benzotriazole compound was omitted, or that a comparative compound as indicated in Table 3 was used instead of the 2-(2'-hydroxyphenyl)benzotriazole compound.

A piece of each dry image forming material was, in a dark room, heat-activated at 100° C. for 5 seconds, and exposed for $\frac{1}{8}$ second through a mask film closely contacted with the material to light emitted from the 500-watt Toshiba Photoreflector Lamp. The exposed material was then heated for 5 seconds on a hot plate maintained at about 120° C. in a dark room to effect heat development.

Another piece of each dry image forming material was subjected to the same accelerated deterioration test (heat- and humidity-acceleration) as in Examples 1 to 4 and Comparative Examples 1 to 6, followed by the same image formation as described above.

In order to examine the light stability of raw material, still another piece of each dry image forming material was subjected to an accelerated deterioration test (fadeometer light-accleration) which was carried out at 40° C. for 2 hours under a light of 200,000 luxes by using a fadeometer FX-1 (trade name of a xenon lamp fadeometer manufactured by Suga Shikenki K. K., Japan), followed by the same image formation as described above.

Still another piece of each image forming material was subjected to an accelerated deterioration test (filtered light-acceleration) which was carried out by exposing, at 40° C. for 2 hours, the material to light emitted from the fadeometer FX-1 and filtered through a VY-45 filter (trade name of a color filter manufactured and sold by Tokyo Shibaura Electric Company Ltd., Japan), which permits only light with wavelengths of 450 nm or more to pass therethrough. The material thus deteriorated was subjected to the same image formation as described above.

The relative sensitivity, fogging and retention of sensitivity of each dry image forming material were examined, and were found to be as shown in Table 3, in which the standard material with a relatively sensitivity of 100 is of Comparative Example 11.

are mentioned below. The comparative compound (C5) is also the known ultraviolet absorber.

(C8)

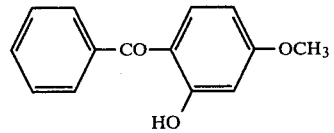

(C9)

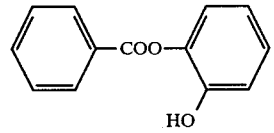

(C10)

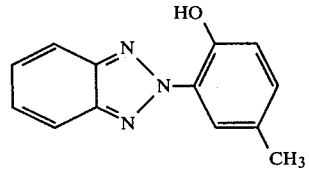

As is apparent from the results shown in Table 3, the 2-(2'-hydroxyphenyl)benzotriazole compounds (f4), (f6) and (f9) having tert-butyl or tert-amyl groups at the 3'- and 5'-positions are very effective for improving the stability of raw dry image forming materials during storage thereof either under heat and humidity or under lighting conditions as compared with the known ultraviolet absorbers.

The fact that the 2-(2'-hydroxyphenyl)benzotriazole compounds (f4), (f6) and (f9) are capable of absorbing only light having wavelengths of less than 400 nm will indicate that the improvement in light stability of raw material achieved in the present invention should not be attributed to the function of the component (f) as the ultraviolet absorber.

EXAMPLES 11 TO 14 AND COMPARATIVE EXAMPLES 16 TO 23

A post-activation type dry image forming material was prepared in substantially the same manner as in Examples 8 to 10 and Comparative Examples 11 to 15 except that recipes [G] and [H] as shown below were employed instead of the recipes [E] and [F], respectively.

TABLE 3

| | | Before Accelerated Deterioration | | After Accelerated Deterioration | | | | | |
|---|---|---|---|---|---|---|---|---|---|
| | | | | Heat and Humidity | | Fadeometer Light | | Filtered Light | |
| Run No. | 2-(2'-Hydroxyphenyl)-benzotriazole Compound or Comparative Compound | Fogging (O.D. min) | Relative Sensitivity | Fogging (O.D. min) | Retention of Sensitivity (%) | Fogging (O.D. min) | Retention of Sensitivity (%) | Fogging (O.D. min) | Retention of Sensitivity (%) |
| Example 8 | (f4) | 0.07 | 94 | 0.16 | 84 | 0.15 | 96 | 0.14 | 95 |
| Example 9 | (f6) | 0.07 | 90 | 0.14 | 82 | 0.14 | 93 | 0.13 | 94 |
| Example 10 | (f9) | 0.07 | 93 | 0.15 | 85 | 0.14 | 91 | 0.14 | 93 |
| Comparative Example 11 | none | 0.07 | 100 | 0.33 | 55 | 0.39 | 58 | 0.34 | 63 |
| Comparative Example 12 | (C8) | 0.07 | 63 | 0.98 | — | 1.23 | — | 1.19 | — |
| Comparative Example 13 | (C9) | 0.07 | 58 | 1.04 | — | 1.31 | — | 1.25 | — |
| Comparative Example 14 | (C10) | 0.07 | 77 | 0.51 | 42 | 0.45 | 37 | 0.39 | 40 |
| Comparative Example 15 | (C5) | 0.07 | 80 | 0.37 | 53 | 0.34 | 43 | 0.33 | 49 |

The comparative compounds (C8), (C9) and (C10) used herein, which are the known ultraviolet absorbers,

| Recipe [G] | |
|---|---|
| Silver behenate suspension | 1.5 g |
| 10 Weight % solution of polyvinyl butyral in methyl ethyl ketone | 2.0 g |
| Solution of 100 mg of mercuric acetate in 3 cc of ethanol | 0.15 cc |
| Solution of 100 mg of nickel dibromide in 1 cc of methanol | 0.15 cc |
| Iodine | 8 mg |
| Triphenylphosphite | 3 mg |
| 1-Phenyl-2,3-dimethyl-3-pyrazolin-5-one | 30 mg |
| α,α,α',α'-Tetrabromo-o-xylene | 25 mg |
| 2-(2'-Hydroxyphenyl)benzotriazole compound as indicated in Table 4 (according to the present invention) | 35 mg |
| **Recipe [H]** | |
| Polymethyl methacrylate | 6.3 g |
| 2,2'-Methylenebis(4-ethyl-6-tert-butylphenol) | 3.5 g |
| Phthalazinone | 0.9 g |
| Acetone | 83 g |

A comparative post-activation type dry image forming material was prepared in substantially the same manner as described above except that the use of the 2-(2'-hydroxyphenyl)benzotriazole compound was omitted, or that a comparative compound as indicated in Table 4 was used instead of the 2-(2'-hydroxyphenyl)-benzotriazole compound.

The relatively sensitivity, fogging and retention of sensitivity of each dry image forming material were examined in the same manner as in Examples 8 to 10 and Comparative Examples 11 to 15, and were found to be as shown in Table 4, in which the standard material with a relative sensitivity of 100 is of Comparative Example 16.

TABLE 4

| Run No. | 2-(2'-Hydroxyphenyl)-benzotriazole Compound or Comparative Compound | Before Accelerated Deterioration: Fogging (O.D. min) | Before Accelerated Deterioration: Relative Sensitivity | After Accelerated Deterioration, Heat and Humidity: Fogging (O.D. min) | Heat and Humidity: Retention of Sensitivity (%) | Fadeometer Light: Fogging (O.D. min) | Fadeometer Light: Retention of Sensitivity (%) | Filtered Light: Fogging (O.D. min) | Filtered Light: Retention of Sensitivity (%) |
|---|---|---|---|---|---|---|---|---|---|
| Example 11 | (f1) | 0.07 | 95 | 0.14 | 83 | 0.14 | 94 | 0.14 | 95 |
| Example 12 | (f2) | 0.07 | 90 | 0.15 | 80 | 0.14 | 92 | 0.14 | 94 |
| Example 13 | (f6) | 0.07 | 91 | 0.15 | 80 | 0.15 | 93 | 0.15 | 94 |
| Example 14 | (f7) | 0.07 | 88 | 0.17 | 78 | 0.16 | 90 | 0.16 | 91 |
| Comparative Example 16 | none | 0.07 | 100 | 0.41 | 58 | 0.36 | 63 | 0.34 | 64 |
| Comparative Example 17 | (C1) | 0.10 | 0.08 | 0.79 | — | 0.87 | — | 0.85 | — |
| Comparative Example 18 | (C2) | 0.09 | 0.05 | 0.32 | — | 0.59 | — | 0.55 | — |
| Comparative Example 19 | (C3) | 0.07 | 39 | 0.58 | 43 | 0.52 | 37 | 0.49 | 40 |
| Comparative Example 20 | (C4) | 0.07 | 43 | 0.51 | 46 | 0.40 | 41 | 0.38 | 43 |
| Comparative Example 21 | (C5) | 0.07 | 52 | 0.40 | 55 | 0.37 | 46 | 0.32 | 50 |
| Comparative Example 22 | (C7) | 0.07 | 66 | 0.37 | 62 | 0.31 | 60 | 0.29 | 62 |
| Comparative Example 23 | (C11) | 0.07 | 0.1 | 0.45 | — | 0.43 | — | 0.40 | — |

The comparative compound (C11) used herein is mentioned below.

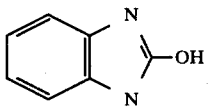

(C11)

As is apparent from the results shown in Table 4, the use of the 2-(2'-hydroxyphenyl)benzotriazole compounds (f1), (f2), (f6) and (f7) having tert-butyl or tert-amyl groups at the 3'- and 5'-positions are very effective for improving the stability of raw dry image forming materials during storage thereof either under heat and humidity or under lighting conditions. The improvement in light stability of raw material achieved by the inclusion of one of the compounds (f1), (f2), (f6) and (f7) evidently should not be attributed to the ultraviolet rays-absorbing function of the compounds (f1), (f2), (f6) and (f7) capable of absorbing only light having wavelengths of less than 400 nm.

COMPARATIVE EXAMPLE 24

A dry image forming material was prepared in substantially the same manner as in Examples 1 to 4 and Comparative Examples 1 to 6 except that, instead of the 2-(2'-hydroxyphenyl)benzotriazole compound, 35 mg of benzotriazole and 0.1 ml of a 0.2 weight % solution of sodium benzenethiosulfonate in methanol were used. The material so obtained was subjected to the same image formation as in Examples 1 to 4 and Comparative Examples 1 to 6. The material could not form an image because it was too poor in sensitivity.

EXAMPLES 15 TO 29 AND COMPARATIVE EXAMPLES 25 TO 35

An already photosensitive type dry image forming material was prepared in substantially the same manner as in Examples 1 to 4 except that recipes [I] and [J] as shown below were employed instead of the recipes [A] and [B], respectively.

| Recipe [I] |
|---|

-continued

| | |
|---|---|
| Silver behenate suspension | 1.5 g |
| 15 Weight % solution of polyvinyl butyral in methyl ethyl ketone | 1.3 g |
| Tetraethylammonium bromide | 12 mg |
| Solution of 10 mg of mercuric acetate in 3 cc of ethanol | 0.15 cc |
| 1-Methyl-2-pyrrolidone | 30 mg |
| 2-(2'-Hydroxyphenyl)benzotriazole compound as shown in Table 5 (according to the present invention) | 35 mg |
| Recipe [J] | |
| 2,2'-Methylenebis(4-methyl-6-tert-butylphenol) | 3.5 g |
| Phthalazinone | 0.9 g |
| Methyl ethyl ketone | 83 g |
| Binder resin as indicated in Table 5 | 6.3 g |

A comparative dry image forming material was prepared in substantially the same manner as described above except that the use of the 2-(2'-hydroxyphenyl)-benzotriazole compound was omitted, or that a comparative compound as indicated in Table 1 was used instead of the 2-(2'-hydroxyphenyl)benzotriazole compound.

A piece of each dry image forming material was subjected to the same image formation as in Examples 1 to 4 and Comparative Examples 1 to 6.

Another piece of each dry image forming material was subjected to an accelerated deterioration test which was carried out by allowing the material to stand in a dark room at 40° C. and at a relative humidity of 80% for 30 days, followed by the same image formation as in Examples 1 to 4 and Comparative Examples 1 to 6.

The O.D. min and $O.D._{0.4}$ of the image materials were measured, and were found to be as shown in Tables 5 and 6.

TABLE 5

| Run No. | 2-(2'Hydroxyphenyl)-benzotriazole Compound | Binder Resin | Before Accelerated Deterioration O.D. min | Before Accelerated Deterioration $O.D._{0.4}$ | After Accelerated Deterioration O.D. min | After Accelerated Deterioration $O.D._{0.4}$ |
|---|---|---|---|---|---|---|
| Example 15 | (f1) | (AR-a) | 0.07 | 0.18 | 0.19 | 0.29 |
| Example 16 | (f1) | (AR-b) | 0.07 | 0.18 | 0.19 | 0.29 |
| Example 17 | (f1) | (AR-c) | 0.07 | 0.20 | 0.20 | 0.31 |
| Example 18 | (f2) | (AR-a) | 0.07 | 0.20 | 0.20 | 0.30 |
| Example 19 | (f2) | (AR-b) | 0.07 | 0.21 | 0.20 | 0.31 |
| Example 20 | (f2) | (AR-c) | 0.07 | 0.22 | 0.21 | 0.32 |
| Example 21 | (f6) | (AR-a) | 0.07 | 0.18 | 0.19 | 0.31 |
| Example 22 | (f6) | (AR-b) | 0.07 | 0.18 | 0.20 | 0.32 |
| Example 23 | (f6) | (AR-c) | 0.07 | 0.20 | 0.21 | 0.32 |
| Example 24 | (f7) | (AR-a) | 0.07 | 0.20 | 0.22 | 0.33 |
| Example 25 | (f7) | (AR-b) | 0.07 | 0.20 | 0.22 | 0.33 |
| Example 26 | (f7) | (AR-c) | 0.07 | 0.21 | 0.22 | 0.33 |
| Example 27 | (f1) | cellulose acetate | 0.07 | 0.25 | 0.26 | 0.44 |
| Example 28 | (f2) | polymethyl methacrylate | 0.07 | 0.27 | 0.26 | 0.45 |
| Example 29 | (f6) | polystyrene | 0.07 | 0.25 | 0.28 | 0.46 |

TABLE 6

| Run No. | Comparative Compound | Binder Resin | Before Accelerated Deterioration O.D. min | Before Accelerated Deterioration $O.D._{0.4}$ | After Accelerated Deterioration O.D. min | After Accelerated Deterioration $O.D._{0.4}$ |
|---|---|---|---|---|---|---|
| Comparative Example 25 | (C1) | cellulose acetate | 0.10 | 0.34 | 0.91 | — |
| Comparative Example 26 | (C2) | cellulose acetate | 0.09 | 0.30 | 0.43 | 0.73 |
| Comparative Example 27 | (C3) | cellulose acetate | 0.07 | 0.28 | 0.71 | 0.98 |
| Comparative Example 28 | (C4) | cellulose acetate | 0.07 | 0.28 | 0.60 | 0.90 |
| Comparative Example 29 | (C5) | cellulose acetate | 0.07 | 0.30 | 0.54 | 0.85 |
| Comparative Example 30 | none | (AR-a) | 0.07 | 0.25 | 0.30 | 0.50 |
| Comparative Example 31 | none | (AR-b) | 0.07 | 0.25 | 0.30 | 0.51 |
| Comparative Example 32 | none | (AR-c) | 0.07 | 0.26 | 0.31 | 0.55 |
| Comparative Example 33 | none | cellulose acetate | 0.07 | 0.30 | 0.83 | — |
| Comparative Example 34 | none | polymethyl methacrylate | 0.07 | 0.30 | 0.46 | 0.79 |
| Comparative Example 35 | none | polystyrene | 0.07 | 0.30 | 0.43 | 0.76 |

The acrylic resin (AR-a) was a blend of polymethyl methacrylate and 40% by weight, based on the polymethyl methacrylate, of a rubber-elastic, partially-crosslinked copolymer obtained by the potassium persulfate-catalyzed emulsion polymerization, in water at 65° C. for 2 hours, of a mixture of 90% by weight of methyl acrylate and 10% by weight of 55% divinylbenzene (a mixture of 55% by weight of divinylbenzene and 45% by weight of ethylvinylbenzene).

The acrylic resin (AR-b) was a copolymer of 80% by weight of methyl methacrylate and 20% by weight of n-butyl acrylate.

The acrylic resin (AR-c) was a 2:1 by weight blend of the acrylic resin (AR-a) mentioned above and polymethyl methacrylate.

As is apparent from the results shown in Table 5 and 6, the dry image forming materials according to a preferred embodiment of the present invention, which comprised an organic silver salt oxidizing agent-containing first coating layer containing one of the 2-(2'-hydroxyphenyl)benzotriazole compounds (f1), (f2), (f6) and (f7), and a reducing agent-containing second coating layer containing, as the binder, a high impact acrylic resin selected from the acrylic resins (AR-a), (AR-b) and (AR-c), were superior, in image quality evaluated in terms of value of $O.D._{0.4}$ before deterioration, and in storage stability of raw material evaluated in terms of degree of fogging and value of $O.D._{0.4}$ after deterioration, to the dry image forming materials according to the present invention, which comprised an organic silver salt oxidizing agent-containing first coating layer containing one of the 2-(2'-hydroxyphenyl)benzotriazole compounds (f1), (f2) and (f6), and a reducing agent-containing second coating layer containing, as the binder, a polymer other than the high impact acrylic resin. The latter materials, however, were superior, in the same respects as mentioned above, to the comparative dry image forming materials comprising an organic silver salt oxidizing agent-containing first coating layer containing no 2-(2'-hydroxyphenyl)benzotriazole compound and none or one of the comparative compounds (C1) to (C5), and a reducing agent-containing second coating layer containing, as the binder, a high impact acrylic resin selected from the acrylic resins (AR-a), (AR-b) and (AR-c) or a polymer of the other kind.

EXAMPLES 30 TO 35 AND COMPARATIVE EXAMPLES 36 TO 37

A homogeneous silver laurate suspension was prepared in the same manner as in the preparation of the silver behenate suspension in Examples 1 to 4 and Comparative Examples 1 to 6.

An already photosensitive type dry image forming material was prepared in substantially the same manner as in Examples 1 to 4 except that recipes [K] and [L] as shown below were used instead of the recipes [A] and [B], respectively.

| Recipe [K] | |
|---|---|
| Silver laurate suspension | 1.5 g |
| 15 Weight % solution of polyvinyl butyral in methyl ethyl ketone | 1.3 g |

-continued

| | |
|---|---|
| Calcium bromide | 12 mg |
| Barium iodide | 8 mg |
| Solution of 10 mg of mercuric bromide in 3 cc of methanol | 0.15 cc |
| 1-Methyl-2-pyrrolidone | 30 mg |
| 2-(2'Hydroxyphenyl)benzotriazole compound as indicated in Table 7 (according to the present invention) | 35 mg |
| Recipe [L] | |
| 1,1'-Bis(2-hydroxy-3-tert-butyl-5-methylphenyl)pentane | 3.5 g |
| Phthalazinone | 0.9 g |
| Methyl ethyl ketone | 83 g |
| Binder resin as indicated in Table 7 | 6.3 g |

A comparative dry image forming material was prepared in substantially the same manner as described above except that the use of the 2-(2'-hydroxyphenyl)-benzotriazole compound was omitted.

A piece of each dry image forming material was subjected to the same image formation as in Examples 1 to 4 and Comparative Examples 1 to 6.

Another piece of each dry image forming material was subjected to the same accelerated deterioration test as in Examples 15 to 29 and Comparative Examples 25 to 35, and subjected to the same image formation as in Examples 1 to 4 and Comparative Examples 1 to 6.

The O.D. min and $O.D._{0.4}$ of the dry image forming material before and after deterioration were examined, and were found to be as shown in Table 7.

TABLE 7

| Run No. | 2-(2'-Hydroxyphenyl)-benzotriazole Compound | Binder Resin | Before Accelerated Deterioration O.D. min | Before Accelerated Deterioration $O.D._{0.4}$ | After Accelerated Deterioration O.D. min | After Accelerated Deterioration $O.D._{0.4}$ |
|---|---|---|---|---|---|---|
| Example 30 | (f3) | (AR-d) | 0.07 | 0.21 | 0.10 | 0.23 |
| Example 31 | (f5) | (AR-d) | 0.07 | 0.20 | 0.10 | 0.23 |
| Example 32 | (f8) | (AR-d) | 0.07 | 0.21 | 0.10 | 0.23 |
| Example 33 | (f3) | polymethyl methacrylate | 0.07 | 0.26 | 0.19 | 0.44 |
| Example 34 | (f5) | polymethyl methacrylate | 0.07 | 0.26 | 0.19 | 0.45 |
| Example 35 | (f8) | polymethyl methacrylate | 0.07 | 0.25 | 0.20 | 0.46 |
| Comparative Example 36 | none | (AR-d) | 0.07 | 0.25 | 0.30 | 0.55 |
| Comparative Example 37 | none | polymethyl methacrylate | 0.07 | 0.29 | 0.48 | 0.80 |

The acrylic resin (AR-d) was a polymer latex obtained by subjecting a mixture of 90 parts by weight of n-butyl acrylate, 10 parts by weight of methyl methacrylate and 0.6 part by weight of triallyl cyanurate to potassium persulfate-catalyzed emulsion polymerization in water at 70° C. for 2 hours under an atmosphere of nitrogen to prepare a latex (solids content: about 33% by weight) of a crosslinked acrylic elastomer and subsequently subjecting a mixture of 30.3 parts by weight of the crosslinked acrylic elastomer latex, 6 parts by weight of acrylonitrile, 12 parts by weight of styrene, 12 parts by weight of methyl methacrylate and 0.3 part by weight of ethylene glycol dimethacrylate to potassium persulfate-catalyzed emulsion polymerization at 70° C. for 2 hours.

As is apparent from the results shown in Table 7, the dry image forming materials according to a preferred embodiment of the present invention, which comprised an organic silver salt oxidizing agent-containing first coating layer containing one of the 2-(2'-hydroxyphenyl)benzotriazole compounds (f3), (f5) and (f8), and a reducing agent-containing second coating layer containing the high impact acrylic resin (AR-d) as the binder, were superior, in image quality evaluated in terms of value of $O.D._{0.4}$ before deterioration, and in storage stability of raw material evaluated in terms of degree of fogging and value of $O.D._{0.4}$ after deterioration, to the dry image forming materials according to the present invention, which comprised an organic silver salt oxidizing agent-containing first coating layer containing one of the 2-(2'hydroxyphenyl)-benzotriazole compounds (f3), (f5) and (f8), and a reducing agent-containing second coating layer containing polymethyl methacrylate as the binder. The latter materials, however, were superior, in storage stability of raw material evaluated as described above, to the comparative dry image forming materials comprising an organic silver salt oxidizing agent-containing first coating layer containing no 2-(2'-hydroxyphenyl)benzotriazole compound, and a reducing agent-containing second coating layer containing, as the binder, the acrylic resin (AR-d) or polymethyl methacrylate.

EXAMPLES 36 TO 41 AND COMPARATIVE EXAMPLES 38 TO 43

A post-activation type dry image forming material was prepared in substantially the same manner as in Examples 8 to 10 except that recipes [M] and [N] as shown below were used instead of the recipes [E] and [F], respectively.

| Recipe [M] | |
|---|---|
| Silver behenate suspension | 1.5 g |
| 15 Weight of solution of polyvinyl butyral in methyl ethyl ketone | 1.3 g |
| Solution of 100 mg of mercuric acetate in 3 cc of ethanol | 0.15 cc |
| α,α,α-Tribromo-p-bromotoluene | 30 mg |
| N—Iodosuccinimide | 12 mg |
| Solution of 100 mg of cobaltic bromide in 1 cc of methanol | 0.15 cc |
| 2-(2'-Hydroxyphenyl)benzotriazole compound as indicated in Table 8 (according to the present invention) | 35 mg |
| Quinoline | 30 mg |

| Recipe [N] | |
|---|---|
| 2,2'-Methylenbis(4-methyl-6-tert-butylphenol) | 3.5 g |
| Phthalazinone | 0.9 g |
| Methyl ethyl ketone | 83 g |
| Binder resin as indicated in Table 8 | 6.3 g |

A comparative dry image forming material was prepared in substantially the same manner as described above except that the use of the 2-(2'-hydroxyphenyl)-benzotriazole compound was omitted, or that a comparative compound as indicated in Table 8 was used instead of the 2-(2'-hydroxyphenyl)benzotriazole compound.

A piece of each dry image forming material was subjected to the same image formation as in Examples 8 to 10 and Comparative Examples 11 to 15.

Another piece of each dry image forming material was subjected to the same accelerated deterioration test (heat- and humidity-acceleration) as in Examples 15 to 29 and Comparative Examples 25 to 35, followed by the same image formation as in Examples 8 to 10 and Comparative Examples 11 to 15.

In order to examine the light stability of raw material, still another piece of each dry image forming material was subjected to an accelerated deterioration test (filtered light-acceleration) which was carried out by exposing, at 40° C. at a relative humidity of 30% for 2 hours, the material to light emitted from the fadeometer FX-1 and filtered through the VY-45 filter, which permits only light with wavelengths of 450 nm or more to pass therethrough. The material thus deteriorated was subject to the same image formation as in Examples 8 to 10 and Comparative Examples 11 to 15.

The O.D. min and $O.D._{0.4}$ of the image materials were measured, and were found to be as shown in Table 8.

TABLE 8

| Run No. | 2-(2'-Hydroxyphenyl) benzotriazole Compound or Comparative Compound | Binder resin | Before Accelerated Deterioration O.D. min | Before Accelerated Deterioration $O.D._{0.4}$ | After Accelerated Deterioration Heat and Humidity O.D. min | After Accelerated Deterioration Heat and Humidity $O.D._{0.4}$ | After Accelerated Deterioration Filtered Light O.D. min | After Accelerated Deterioration Filtered Light $O.D._{0.4}$ |
|---|---|---|---|---|---|---|---|---|
| Example 36 | (f4) | (AR-e) | 0.07 | 0.21 | 0.11 | 0.22 | 0.10 | 0.22 |
| Example 37 | (f6) | (AR-e) | 0.07 | 0.19 | 0.10 | 0.20 | 0.09 | 0.20 |
| Example 38 | (f9) | (AR-e) | 0.07 | 0.22 | 0.12 | 0.23 | 0.11 | 0.23 |
| Example 39 | (f4) | cellulose acetate | 0.07 | 0.25 | 0.19 | 0.44 | 0.18 | 0.43 |
| Example 40 | (f6) | cellulose acetate | 0.07 | 0.25 | 0.18 | 0.30 | 0.17 | 0.29 |
| Example 41 | (f9) | cellulose acetate | 0.07 | 0.26 | 0.20 | 0.32 | 0.19 | 0.31 |
| Comparative Example 38 | none | (AR-e) | 0.07 | 0.26 | 0.22 | 0.54 | 0.19 | 0.41 |
| Comparative Example 39 | none | cellulose acetate | 0.07 | 0.31 | 0.89 | — | 0.67 | — |
| Comparative Example 40 | (C8) | (AR-e) | 0.07 | 0.30 | 0.97 | — | 1.01 | — |
| Comparative Example 41 | (C9) | (AR-e) | 0.07 | 0.31 | 1.23 | — | 1.15 | — |
| Comparative Example 42 | (C10) | (AR-e) | 0.07 | 0.30 | 0.67 | 0.97 | 0.55 | 0.75 |
| Comparative Example 43 | (C12) | (AR-e) | 0.07 | 0.29 | 0.43 | 0.73 | 0.40 | 0.61 |

The acrylic resin (AR-e) was a polymer obtained by subjecting a mixture of 61.5 parts by weight of n-butyl acrylate, 13.5 parts by weight of styrene and 0.4 parts by weight of butylene glycol diacrylate to potassium persulfate-catalyzed emulsion polymerization in water at 70° C. for 30 minutes to prepare a copolymer, polymerizing at 70° C. for 1 hour 25 parts by weight of methyl methacrylate in the presence of said copolymer to prepare a rubbery elastomer and subsequently subjecting a 4% by weight dispersion of said rubbery elastomer dispersed in a monomer mixture composed of 96% by weight of methyl methacrylate and 4% by weight of ethyl acetate to free-radical polymerization at 80° C. for 1 hour.

The comparative compound (C12) used herein is mentioned below.

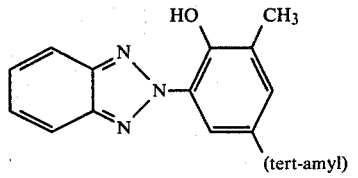

(C12)

As is apparent from the results shown in Table 8, the dry image forming materials according to a preferred embodiment of the present invention, which comprised an organic silver salt oxidizing agent-containing first coating layer containing one of the 2-(2'-hydroxyphenyl)benzotriazole compounds (f4), (f6) and (f9), and a reducing agent-containing second coating layer containing the high impact acrylic resin (AR-e) as the binder, were superior, in image quality evaluated in terms of value of $O.D._{0.4}$ before deterioration, and in storage stability of raw material evaluated in terms of degree of fogging and value of $O.D._{0.4}$ after deterioration (either heat- and humidity-acceleration or filtered light-acceleration), to the dry image forming materials according to the prevent invention, which comprised an organic silver salt oxidizing agent-containing first coating layer containing one of the 2-(2'-hydroxyphenyl)benzotriazole compound (f4), (f6) and (f9), and a reducing agent-containing second coating layer containing cellulose acetate as the binder. The latter materials, however, were superior, in the same respects as mentioned above, to the comparative dry image forming materials comprising an organic silver salt oxidizing agent-containing first coating layer containing no 2-(2'-hydroxyphenyl)benzotriazole compound and none or one of the comparative compounds (C8), (C9), (C10) and (C12), and a reducing agent-containing second coating layer containing, as the binder, the acrylic resin (AR-e) or cellulose acetate.

The fact that the 2-(2'-hydroxyphenyl)benzotriazole compounds (f4), (f6) and (f9) are capable of absorbing only light having wavelengths of less than 400 nm will indicate that the improvement in light stability of raw material achieved in the present invention should not be attributed to the function of the component (f) as the ultraviolet absorber.

EXAMPLES 42 AND 43 AND COMPARATIVE EXAMPLES 44 TO 47

An already photosensitive dry image forming material was prepared in substantially the same manner as in Examples 1 to 4 except that recipes [O] and [P] as shown below were used instead of the recipes [A] and [B], respectively.

| Recipe [O] | |
|---|---|
| Silver behenate suspension | 1.5 g |
| 15 Weight % solution of polyvinyl butyral in methyl ethyl ketone | 1.3 g |
| Silver bromide | 11 mg |
| Solution of 10 mg of mercuric acetate in 3 cc of methanol | 0.15 cc |
| 1-Methyl-2-pyrrolidone | 30 mg |
| 2-(2'-Hydroxyphenyl)benzotriazole compound (f1) | 35 mg |

| Recipe [P] | |
|---|---|
| 2,4,4'-Trimethylpenthylbis(2-hydroxy-3,5-dimethylphenyl)methane | 2.8 g |
| Phthalazinone | 0.9 g |
| Methyl ethyl ketone | 83 g |
| Binder resin as indicated in Table 9 | 6.3 g |

A comparative dry image forming material was prepared in substantially the same manner as described above except that the use of the 2-(2'-hydroxyphenyl)-benzotriazole compound was omitted.

Five pieces of each dry image forming material were each subjected to substantially the same image formation as in Examples 1 to 4 and Comparative Examples 1 to 6 except that the development temperature were varied as shown in Table 9.

The relative sensitivity and $O.D._{0.4}$ of the imaged materials were examined, and were found to be as shown in Table 9, in which the standard material with a relative sensitivity of 100 when developed at 125° C. for 4 seconds is of Example 42.

TABLE 9

| | 2-(2'-Hydroxyphenyl)benzotriazole Compound | Binder Resin | Development Temperature (°C.) 115° C. | | 120° C. | | 125° C. | | 130° C. | | 135° C. | |
|---|---|---|---|---|---|---|---|---|---|---|---|---|
| Run No. | | | Relative Sensitivity | $O.D._{0.4}$ | Relative Sensitivity | $O.D._{0.4}$ | Relative Sensitivity | $O.D._{0.4}$ | Relative Sensitivity | $O.D._{0.4}$ | Relative Sensitivity | $O.D._{0.4}$ |
| Example 42 | (f1) | (AR-a) | 90 | 0.26 | 90 | 0.20 | 100 | 0.20 | 150 | 0.23 | 250 | 0.33 |
| Example 43 | (f1) | (AR-d) | 89 | 0.26 | 92 | 0.20 | 101 | 0.20 | 150 | 0.23 | 253 | 0.33 |
| Comparative Example 44 | none | (AR-a) | 71 | 0.34 | 90 | 0.25 | 100 | 0.30 | 203 | 0.35 | 351 | 0.49 |
| Comparative Example 45 | none | (AR-d) | 71 | 0.34 | 92 | 0.25 | 101 | 0.30 | 200 | 0.35 | 349 | 0.49 |
| Comparative Example 46 | none | cellulose acetate | 21 | 0.41 | 40 | 0.31 | 71 | 0.35 | 198 | 0.43 | 401 | 0.58 |
| Comparative Example 47 | none | polymethyl methacrylate | 60 | 0.41 | 91 | 0.31 | 121 | 0.34 | 200 | 0.42 | 350 | 0.53 |

As is apparent from the results shown in Table 9, the combinations of the 2-(2'-hydroxyphenyl)benzotriazole compound (f1) (according to the present invention)

with the high impact acrylic resin (AR-a) or (AR-d) provided the dry image forming materials which were subject to smaller variations in sensitivity and $O.D._{0.4}$ with heat development conditions than the comparative dry image forming materials containing no 2-(2'-hydroxyphenyl)benzotriazole compound.

EXAMPLES 44 AND 45 AND COMPARATIVE EXAMPLES 48 TO 51

A post-activation type dry image forming material was prepared in substantially the same manner as in Examples 8 to 10 except that recipe [Q] as shown below and the recipe [P] as used in Examples 42 to 43 (the binder resin was as indicated in Table 10) were used instead of the recipes [E] and [F], respectively.

| Recipe [Q] | |
|---|---|
| Silver behenate suspension | 1.5 g |
| 15 Weight % solution of polyvinyl butyral in methyl ethyl ketone | 1.3 g |
| Solution of 100 mg of mercuric acetate in 3 cc of ethanol | 0.15 cc |
| N—Iodosuccinimide | 17 mg |
| Diphenylbromomethane | 4 mg |
| Quinoline | 30 mg |
| α,α,α',α'-Tetrabromo-m-xylene | 30 mg |
| 2-(2'-Hydroxyphenyl)benzotriazole compound (f6) | 35 mg |

Five pieces of each dry image forming material were each subjected to substantially the same image formation as in Examples 15 to 29 and Comparative Examples 25 to 35 except that the material was preliminarily heated at 100° C. for 5 seconds and that the development temperatures were varied as shown in Table 10.

The relative sensitivity and $O.D._{0.4}$ of the imaged materials were examined, and were found to be as shown in Table 10, in which the standard material with a relative sensitivity of 100 when developed at 125° C. for 4 seconds is of Example 44.

EXAMPLES 46 TO 51 AND COMPARATIVE EXAMPLES 49 TO 52

A post-activation type dry image forming material was prepared in substantially the same manner as in Examples 8 to 10 except that recipes [R] and [S] as shown below were used instead of the recipes [E] and [F], respectively.

| Recipe [R] | |
|---|---|
| Silver behenate suspension | 1.5 g |
| 15 Weight % solution of polyvinyl butyral in methyl ethyl ketone | 1.3 g |
| Solution of 100 mg of mercuric acetate in 3 cc of ethanol | 0.15 cc |
| Solution of 100 mg of nickel bromide in 1 cc of methanol | 0.15 cc |
| Iodine | 8 mg |
| Triphenyl phosphite | 3 mg |
| 1-Phenyl-2,3-dimethyl-3-pyrazolin-5-one | 30 mg |
| α,α,α',α'-Tetrabromo-o-xylene | 25 mg |
| 2-(2'-Hydroxyphenyl)benzotriazole compound as indicated in Table 11 (according to the present invention) | 35 mg |
| **Recipe [S]** | |
| 2,2'-Methylenebis(4-ethyl-6-tert-butylphenol) | 3.5 g |
| Phthalazinone | 0.9 g |
| Methyl ethyl ketone | 83.0 g |
| Binder resin as indicated in Table 11 | 6.3 g |

A piece of each dry image forming material was subjected to the same image formation as in Examples 8 to 10 and Comparative Examples 11 to 15.

In order to examine the stability of latent image, four pieces of each dry image forming material, after subjected to the same heat-activation and light exposure as in Examples 8 to 10 and Comparative Examples 11 to 15 were allowed to stand in a dark room for 0.5, 1, 5 and 10 hours, respectively, and then heat-developed for 5 seconds on a hot plate maintained at 125° C.

The relative sensitivity and latent image stability of the dry image forming material were examined, and were found to be as shown in Table 11, in which the standard material with a relative sensitivity of 100 is of Comparative Example 52, and in which the latent image stability is expressed as corresponding to retention of sensitivity when the standing of the material in the dark room for a given time is regarded as an accelerated deterioration test.

TABLE 10

| | | | Development Temperature (°C.) | | | | | | | | | |
|---|---|---|---|---|---|---|---|---|---|---|---|---|
| | | | 115° C. | | 120° C. | | 125° C. | | 130° C. | | 135° C. | |
| Run No. | 2-(2'-Hydroxyphenyl)benzotriazole Compound | Binder Resin | Relative Sensitivity | $O.D._{0.4}$ | Relative Sensitivity | $O.D._{0.4}$ | Relative Sensitivity | $O.D._{0.4}$ | Relative Sensitivity | $O.D._{0.4}$ | Relative Sensitivity | $O.D._{0.4}$ |
| Example 44 | (f6) | (AR-a) | 91 | 0.26 | 90 | 0.20 | 100 | 0.20 | 149 | 0.23 | 249 | 0.33 |
| Example 45 | (f6) | (AR-d) | 90 | 0.26 | 91 | 0.20 | 101 | 0.20 | 150 | 0.23 | 252 | 0.33 |
| Comparative Example 48 | none | (AR-a) | 71 | 0.35 | 91 | 0.25 | 100 | 0.31 | 202 | 0.35 | 350 | 0.49 |
| Comparative Example 49 | none | (AR-d) | 70 | 0.35 | 92 | 0.25 | 101 | 0.30 | 200 | 0.35 | 350 | 0.49 |
| Comparative Example 50 | none | cellulose acetate | 20 | 0.41 | 41 | 0.31 | 70 | 0.35 | 200 | 0.43 | 400 | 0.59 |
| Comparative Example 51 | none | polymethyl methacrylate | 61 | 0.40 | 91 | 0.31 | 122 | 0.35 | 201 | 0.41 | 352 | 0.53 |

As is apparent from the results shown in Table 10, the combinations of the 2-(2'-hydroxyphenyl)benzotriazole (f6) (according to the present invention) with the high impact acrylic resin (AR-a) or (AR-d) provided the dry image forming materials which were subject to smaller variations in sensitivity and $O.D._{0.4}$ with heat development conditions than the comparative dry image forming materials containing no 2-(2'-hydroxyphenyl)benzotriazole compound.

TABLE 11

| Run No. | 2-(2'-Hydroxyphenyl) benzotriazole Compound | Binder Resin | Relative Sensitivity | Latent Image Stability (%) 0.5 hour | 1 hour | 5 hours | 10 hours |
|---|---|---|---|---|---|---|---|
| Example 46 | (f1) | (AR-a) | 85 | 100 | 100 | 100 | 92 |
| Example 47 | (f1) | (AR-f) | 86 | 100 | 100 | 100 | 90 |
| Example 48 | (f1) | (AR-g) | 85 | 100 | 100 | 100 | 89 |
| Example 49 | (f6) | (AR-a) | 85 | 100 | 100 | 100 | 90 |
| Example 50 | (f6) | (AR-f) | 85 | 100 | 100 | 100 | 90 |
| Example 51 | (f6) | (AR-g) | 85 | 100 | 100 | 100 | 90 |
| Comparative Example 49 | none | (AR-a) | 85 | 70 | 61 | 50 | 40 |
| Comparative Example 50 | none | (AR-f) | 85 | 72 | 62 | 49 | 41 |
| Comparative Example 51 | none | (AR-g) | 85 | 72 | 60 | 51 | 40 |
| Comparative Example 52 | none | polymethyl methacrylate | 100 | 51 | 35 | 20 | 10 |

The acrylic resin (AR-f) was a blend of polymethyl methacrylate and 40% by weight, based on the polymethyl methacrylate, of Tufprene A (trade name of a styrene-butadiene block copolymer manufactured by Asahi Kasei Kogyo Kabushiki Kaisha, Japan).

The acrylic resin (AR-g) was a blend of polymethyl methacrylate and 40% by weight, based on the polymethyl methacrylate, of a rubber-elastic, partially-crosslinked copolymer obtained by the potassium persulfate-catalyzed emulsion polymerization, in water at 60° C. for 2 hours, of a mixture of 90% by weight of methyl acrylate and 10% by weight of dipropylene glycol dimethacrylate.

As is apparent from the results shown in Table 11, the combinations of the 2-(2'-hydroxyphenyl)benzotriazole compound (f1) or (f6) (according to the present invention) with the high impact acrylic resin (AR-a), (AR-f) or (AR-g) provided the dry image forming materials having a higher latent image stability than those of the dry image forming materials containing no 2-(2'-hydroxyphenyl)benzotriazole compound.

A dry image forming material was prepared in substantially the same manner as in each of Examples 46 to 51 and Comparative Examples 49 to 52 except that 3 mg of cobalt dibromide was used instead of the methanol solution of nickel bromide. With respect to each dry image forming material, the results evaluated in terms of relative sensitivity and latent image stability were substantially the same as those obtained with respect to the dry image forming material prepared in the corresponding Example or Comparative Example.

EXAMPLES 52 TO 66 AND COMPARATIVE EXAMPLES 53 TO 68

A post-activation type dry image forming material was prepared in substantially the same manner as in Examples 8 to 10 except that recipes [T] and [U] as shown below were used instead of the recipes [E] and [F], respectively. The amount of silver behenate contained in the first coating layer was about 4 g/m$^2$ of the layer.

| Recipe [T] | |
|---|---|
| Silver behenate suspension | 1.5 g |
| 15 Weight % solution of polyvinyl butyral in methyl ethyl ketone | 1.3 g |
| Solution of 100 mg of mercuric iodide in 9 cc of acetone | 0.5 cc |
| Bis-p-methoxyphenyltellurium diiodide | 28 mg |
| Bis-p-methoxyphenyltellurium dibromide | 14 mg |
| α,α,α',α'-Tetrabromo-o-xylene | 30 mg |

-continued

| | |
|---|---|
| Quinoline | 30 mg |
| Solution of 10 mg of dye compound as indicated in Table 12 in 10 cc of methanol | 0.1 cc |
| 2-(2'-Hydroxyphenyl)benzotriazole compound as indicated in Table 12 (according to the present invention) | 35 mg |
| Recipe [U] | |
| Cellulose acetate | 6.3 g |
| 2,6-Methylenebis(2-hydroxy-3-tert-butyl-5-methylphenyl)-4-methylphenol | 3.2 g |
| Acetone | 83.0 g |
| Phthalazinone | 1.2 g |

A comparative dry image forming material was prepared in substantially the same manner as described above except that the use of the 2-(2'-hydroxyphenyl)benzotriazole compound was omitted, or that a comparative compound as indicated in Table 13 was used instead of the 2-(2'-hydroxyphenyl)benzotriazole compound.

A piece of each dry image forming material was preliminarily heated on a hot plate maintained at about 100° C. for 3 seconds in a dark room. Then, the material was exposed for 1 second through a 21-step steptablet (manufactured and sold by Eastman Kodak Co., Ltd., U.S.A.) to light emitted from a tungsten lamp having a color temperature of 3,200° K. and filtered through a yellow color filter Y-50 (trade name of a color filter manufactured and sold by Tokyo Shibaura Electric Company Ltd., Japan). The exposed material was then heated on a hot plate maintained at about 125° C. for 4 seconds in the dark room to effect heat development.

Another piece of each dry image forming material was subjected to an accelerated deterioration test (heat- and humidity-acceleration) which was carried out by allowing the material to stand in the dark at 45° C. and at a relative humidity of 80% for 10 days. The deteriorated material was subjected to the same image formation as described above.

The optical densities of the imaged materials respectively derived from the materials before and after subjected to the accelerated deterioration test were measured. The results evaluated in terms of relative sensitivity, fogging (O.D. min) and retention of sensitivity are shown in Tables 12 and 13, in which the dye compounds (1), (4), (5), (18) and (28) indicate the aforementioned spectral sensitizing dye compounds listed under such numbers (such indications used hereinafter have the same meanings), and in which the standard material with a relative sensitivity of 100 is of Example 52.

TABLE 12

| Run No. | Dye Compound | 2-(2'-Hydroxyphenyl)-benzotriazole Compound | Before Accelerated Deterioration: Relative Sensitivity | Before Accelerated Deterioration: Fogging (O.D. min) | After Accelerated Deterioration: Retention of Sensitivity (%) | After Accelerated Deterioration: Fogging (O.D. min) |
|---|---|---|---|---|---|---|
| Example 52 | (1) | (f1) | 100 | 0.09 | 77 | 0.12 |
| Example 53 | (1) | (f2) | 99 | 0.09 | 78 | 0.12 |
| Example 54 | (1) | (f7) | 100 | 0.09 | 80 | 0.12 |
| Example 55 | (4) | (f1) | 401 | 0.09 | 69 | 0.11 |
| Example 56 | (4) | (f2) | 400 | 0.09 | 68 | 0.11 |
| Example 57 | (4) | (f7) | 398 | 0.09 | 68 | 0.11 |
| Example 58 | (5) | (f1) | 82 | 0.09 | 59 | 0.12 |
| Example 59 | (5) | (f2) | 80 | 0.09 | 58 | 0.12 |
| Example 60 | (5) | (f7) | 80 | 0.09 | 58 | 0.12 |
| Example 61 | (18) | (f1) | 30 | 0.09 | 95 | 0.10 |
| Example 62 | (18) | (f2) | 201 | 0.09 | 95 | 0.10 |
| Example 63 | (18) | (f7) | 200 | 0.09 | 94 | 0.10 |
| Example 64 | (28) | (f1) | 252 | 0.09 | 61 | 0.11 |
| Example 65 | (28) | (f2) | 249 | 0.09 | 60 | 0.11 |
| Example 66 | (28) | (f7) | 250 | 0.09 | 60 | 0.11 |

TABLE 13

| Run No. | Dye Compound | Comparative Compound | Before Accelerated Deterioration: Relative Sensitivity | Before Accelerated Deterioration: Fogging (O.D. min) | After Accelerated Deterioration: Retention of Sensitivity (%) | After Accelerated Deterioration: Fogging (O.D. min) |
|---|---|---|---|---|---|---|
| Comparative Example 53 | none | none | 0 | 0.08 | 0 | 0.21 |
| Comparative Example 54 | (D-a) | none | 12 | 0.51 | 0 | 0.65 |
| Comparative Example 55 | (D-b) | none | 8 | 0.32 | 0 | 0.64 |
| Comparative Example 56 | (D-c) | none | 14 | 0.64 | 0 | 0.65 |
| Comparative Example 57 | (D-d) | none | 15 | 0.52 | 0 | 0.81 |
| Comparative Example 58 | (D-e) | none | 7 | 0.21 | 0 | 0.83 |
| Comparative Example 59 | (1) | none | 100 | 0.09 | 35 | 0.37 |
| Comparative Example 60 | (4) | none | 402 | 0.09 | 36 | 0.29 |
| Comparative Example 61 | (5) | none | 81 | 0.09 | 30 | 0.38 |
| Comparative Example 62 | (18) | none | 30 | 0.09 | 45 | 0.31 |
| Comparative Example 63 | (28) | none | 251 | 0.09 | 31 | 0.30 |
| Comparative Example 64 | (1) | (C1) | 73 | 0.14 | 0 | 0.65 |
| Comparative Example 65 | (1) | (C2) | 73 | 0.11 | 0 | 0.61 |
| Comparative Example 66 | (1) | (C3) | 84 | 0.09 | 11 | 0.35 |
| Comparative Example 67 | (1) | (C4) | 92 | 0.09 | 12 | 0.36 |
| Comparative Example 68 | (1) | (C5) | 93 | 0.09 | 11 | 0.36 |

The dye compounds (D-a) to (D-e) used herein are mentioned below.

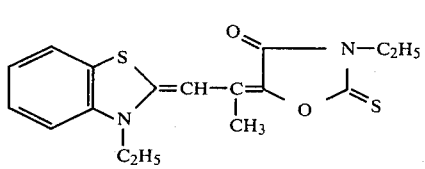

(D-a)

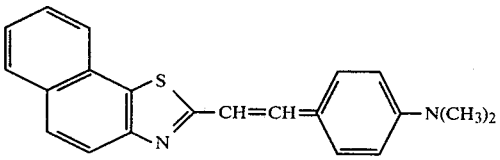

(D-b)

-continued

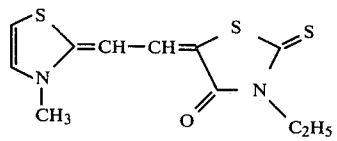

(D-c)

3-Allyl-5-[3-ethyl-(2-naphthoxazolidine)-ethylidene]-1-phenyl-2-thiohydantoin (D-d)

-continued (D-e)

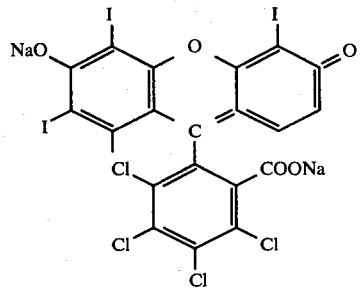

As is apparent from the results shown in Tables 12 and 13, the combinations of the 2-(2'-hydroxyphenyl)-benzotriazole compound (f1), (f2) or (f7) (according to the present invention) with the dye compound (1), (4), (5), (18) or (28) provided the dry image forming materials having higher spectral sensitivity and storage stability of raw material (evaluated in terms of fogging and retention of sensitivity) than those of the comparative dry image forming materials containing no 2-(2'-hydroxyphenyl)-benzotriazole compound and none or one of the comparative compounds (C1) to (C5).

EXAMPLES 67 TO 70 AND COMPARATIVE EXAMPLES 69 TO 79

A post-activation type dry image forming material was prepared in substantially the same manner as in Examples 8 to 10 except that recipes [V] and [W] as shown below were used instead of the recipes [E] and [F], respectively.

| Recipe [V] | |
|---|---|
| Silver behenate suspension | 1.5 g |
| 15 Weight % solution of polyvinyl butyral in methyl ethyl ketone | 1.3 g |
| Solution of 100 mg of mercuric iodide in 9 cc of acetone | 0.5 cc |
| 2,2,2-Tribromoethanol | 45 mg |
| N—Iodosuccinimide | 63 mg |
| Cobalt dibromide | 3 mg |
| 1-Methyl-2-pyrrolidone | 20 mg |
| Solution of 10 mg of dye compound as indicated in Table 14 in 10 cc of methanol | 0.2 cc |
| 2-(2'-Hydroxyphenyl)benzotriazole compound (f6) | 35 mg |

| Recipe [W] | |
|---|---|
| Cellulose acetate | 6.3 g |
| 2,4,4'-trimethylpenthylbis(2-hydroxy-3,5-dimethylphenyl)methane | 2.8 g |
| Phthalazinone | 1.2 g |
| Acetone | 83.0 g |

A comparative dry image forming material was prepared in substantially the same manner as described above except that the use of the 2-(2'-hydroxyphenyl)-benzotriazole compound was omitted, or that the comparative compound (C12) was used instead of the 2-(2'-hydroxyphenyl)benzotriazole compound.

A piece of each dry image forming material was subjected to the same image formation as in Examples 52 to 66 and Comparative Examples 53 to 68.

Another piece of each dry image forming material was subjected to the same accelerated deterioration test (heat-and humidity-acceleration) as in Examples 52 to 66 and Comparative Examples 53 to 68, followed by the same image formation as in Examples 52 to 66 and Comparative Examples 53 to 68.

The relative sensitivity, fogging and retention of sensitivity of each dry image forming material were examined in the same manner as in Examples 52 to 66 and Comparative Examples 53 to 68, and were found to be as shown in Table 14, in which the standard material with a relative sensitivity of 100 is of Example 67.

TABLE 14

| Run No. | Dye Compound | 2-(2'-Hydroxyphenyl)-benzotriazole Compound or Comparative Compound | Before Accelerated Deterioration: Relative Sensitivity | Before Accelerated Deterioration: Fogging (O.D. min) | After Accelerated Deterioration: Retention of Sensitivity (%) | After Accelerated Deterioration: Fogging (O.D. min) |
|---|---|---|---|---|---|---|
| Example 67 | (22) | (f6) | 100 | 0.09 | 57 | 0.13 |
| Example 68 | (23) | (f6) | 65 | 0.09 | 62 | 0.13 |
| Example 69 | (25) | (f6) | 123 | 0.09 | 71 | 0.12 |
| Example 70 | (37) | (f6) | 132 | 0.09 | 52 | 0.13 |
| Comparative Example 69 | none | none | 0 | 0.08 | 0 | 0.27 |
| Comparative Example 70 | (22) | none | 100 | 0.09 | 10 | 0.61 |
| Comparative Example 71 | (23) | none | 67 | 0.09 | 6 | 0.30 |
| Comparative Example 72 | (25) | none | 122 | 0.09 | 13 | 0.38 |
| Comparative Example 73 | (37) | none | 129 | 0.09 | 5 | 0.26 |
| Comparative Example 74 | (22) | (C12) | 71 | 0.09 | 0 | 0.31 |
| Comparative Example 75 | (23) | (C12) | 47 | 0.09 | 0 | 0.31 |
| Comparative Example 76 | (25) | (C12) | 81 | 0.09 | 0 | 0.30 |
| Comparative Example 77 | (37) | (C12) | 92 | 0.09 | 0 | 0.31 |
| Comparative Example 78 | (D-f) | none | 0 | 0.35 | 0 | 0.43 |
| Comparative Example 79 | (D-g) | none | 27 | 0.35 | 0 | 0.38 |

The dye compounds (D-f) and (D-g) used herein are mentioned below.

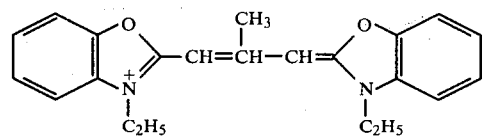

(D-f)

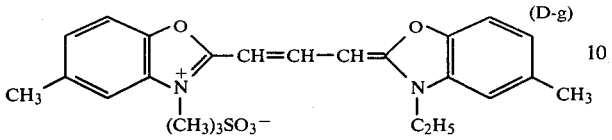

(D-g)

As is apparent from the results shown in Table 14, the combinations of the 2-(2'-hydroxyphenyl)benzotriazole compound (f6) (according to the present invention) with the dye compound (22), (23), (25) or (37) provided the dry image forming materials having higher spectral sensitivity and storage stability of raw material (evaluated in terms of fogging and retention of sensitivity) than those of the comparative dry image forming materials containing no 2-(2'-hydroxyphenyl)benzotriazole compound or the comparative compound (C12).

EXAMPLES 71 TO 78 AND COMPARATIVE EXAMPLES 69 TO 79

To 20 g of a mixed solvent of toluene and methyl ethyl ketone (mixing weight ratio = 1:2) was added 3.5 g of silver stearate, and the mixture was ball-milled for about 18 hours to obtain a homogeneous silver stearate suspension.

A post-activation type dry image forming material was prepared in substantially the same manner as in Examples 8 to 10 except that recipes [X] and [Y] as shown below were used instead of the recipes [E] and [F], respectively.

| Recipe [X] | |
|---|---|
| Silver stearate suspension | 1.5 g |
| 15 Weight % solution of polyvinyl butyral in methyl ethyl ketone | 1.3 g |
| Iodine | 8 mg |
| Triphenyl phosphite | 4 mg |
| Nickel dibromide | 4 mg |
| Solution of 100 mg of mercuric acetate in 3 cc of methanol | 0.15 cc |
| α,α,α',α'-Tetrabromo-m-xylene | 30 mg |
| Solution of 10 mg of dye compound as indicated in Table 15 in 10 cc of methanol | 0.2 cc |
| 2-(2'-Hydroxyphenyl)benzotriazole compound as indicated in Table 15 (according to the present invention) | 35 mg |
| 1-Phenyl-2,3-dimethyl-3-pyrazolin-5-one | 30 mg |
| **Recipe [Y]** | |
| Polymethyl methacrylate | 6.3 g |
| 2,2'-Methylenebis(4-ethyl-6-tert-butylphenol) | 3.5 g |
| Phthalazinone | 1.2 g |
| Methyl ethyl ketone | 83.0 g |

A comparative dry image forming material was prepared in substantially the same manner as described above except that the use of the 2-(2'-hydroxyphenyl)-benzotriazole compound was omitted, or that a comparative compound as indicated in Table 15 was used instead of the 2-(2'-hydroxyphenyl)benzotriazole compound.

A piece of each dry image forming material was subjected to substantially the same image formation as in Examples 52 to 66 and Comparative Examples 53 to 68 except that the light exposure was carried out for 8 seconds by using a light with a wavelength of 480 nm emitted from a monochrometer.

Another piece of each dry image forming material was subjected to the same accelerated deterioration test (heat-and humidity-acreleration) as in Examples 52 to 66 and Comparative Examples 53 to 68, followed by the same image formation as described above.

In order to examine the light stability of raw material, still another piece of each image forming material was subjected to an accelerated deterioration test (filtered light-acceleration) which was carried out by exposing, at 40° C. for 2 hours, the material to light emitted from the fadeometer FX-1 and filtered through a VY-45 filter (trade name of a color filter manufactured and sold by Tokyo Shibaura Electric Company Ltd., Japan), which permits only light with wavelengths of 450 nm or more to pass therethrough. The material thus deteriorated was subjected to the same image formation as described above.

The relative sensitivity, fogging and retention of sensitivity of each dry image forming material were examined, and were found to be as shown in Table 15, in which the standard material with a relative sensitivity of 100 is of Example 71.

| | | | Before Accelerated Deterioration | | After Accelerated Deterioration | | | |
|---|---|---|---|---|---|---|---|---|
| | | | | | Heat and Humidity | | Filtered Light | |
| Run No. | Dye Compound | 2-(2'-Hydroxyphenyl)-benzotriazole Compound or Comparative Compound | Relative Sensitivity | Fogging (O.D. min) | Retention of Sensitivity (%) | Fogging (O.D. min) | Retention of Sensitivity (%) | Fogging (O.D. min) |
| Example 71 | (38) | (f3) | 100 | 0.09 | 71 | 0.12 | 62 | 0.11 |
| Example 72 | (39) | (f3) | 201 | 0.09 | 62 | 0.12 | 55 | 0.11 |
| Example 73 | (40) | (f3) | 200 | 0.09 | 75 | 0.11 | 70 | 0.11 |
| Example 74 | (43) | (f3) | 176 | 0.09 | 57 | 0.11 | 52 | 0.11 |
| Example 75 | (38) | (f9) | 102 | 0.09 | 71 | 0.12 | 61 | 0.11 |
| Example 76 | (39) | (f9) | 203 | 0.09 | 62 | 0.12 | 54 | 0.11 |
| Example 77 | (40) | (f9) | 200 | 0.09 | 75 | 0.11 | 70 | 0.11 |
| Example 78 | (43) | (f9) | 176 | 0.09 | 58 | 0.12 | 52 | 0.11 |
| Comparative Example 69 | none | none | 0 | 0.08 | 0 | 0.25 | 0 | 0.11 |
| Comparative Example 70 | (38) | none | 102 | 0.09 | 35 | 0.30 | 28 | 0.18 |
| Comparative Example 71 | (39) | none | 201 | 0.09 | 30 | 0.34 | 20 | 0.18 |
| Comparative | | | | | | | | |

-continued

| Run No. | Dye Compound | 2-(2'-Hydroxyphenyl)-benzotriazole Compound or Comparative Compound | Before Accelerated Deterioration: Relative Sensitivity | Before Accelerated Deterioration: Fogging (O.D. min) | After Accelerated Deterioration, Heat and Humidity: Retention of Sensitivity (%) | After Accelerated Deterioration, Heat and Humidity: Fogging (O.D. min) | After Accelerated Deterioration, Filtered Light: Retention of Sensitivity (%) | After Accelerated Deterioration, Filtered Light: Fogging (O.D. min) |
|---|---|---|---|---|---|---|---|---|
| Example 72 | (40) | none | 200 | 0.09 | 40 | 0.30 | 40 | 0.18 |
| Comparative Example 73 | (43) | none | 174 | 0.09 | 31 | 0.35 | 25 | 0.18 |
| Comparative Example 74 | (D-h) | none | 0 | 0.08 | 0 | 0.30 | 0 | 0.30 |
| Comparative Example 75 | (D-i) | none | 0 | 0.09 | 0 | 0.29 | 0 | 0.30 |
| Comparative Example 76 | (D-j) | none | 29 | 0.09 | 0 | 0.22 | 21 | 0.23 |
| Comparative Example 77 | (38) | (C8) | 80 | 0.09 | 0 | 1.19 | 0 | 0.73 |
| Comparative Example 78 | (39) | (C9) | 69 | 0.09 | 0 | 1.02 | 0 | 0.62 |
| Comparative Example 79 | (43) | (C13) | 92 | 0.09 | 35 | 0.48 | 30 | 0.16 |

The dye compounds (D-h), (D-i) and (D-j) used herein are mentioned below.

(D-h)

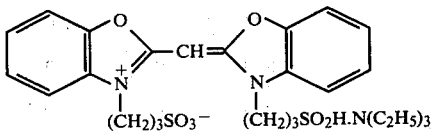

(D-i)

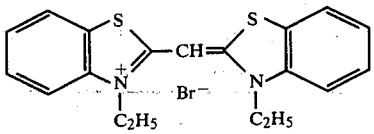

(D-j)

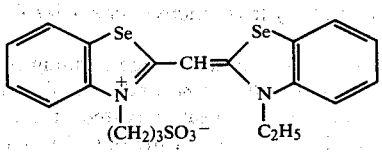

The comparative compound (C13) used herein is mentioned below.

(C13)

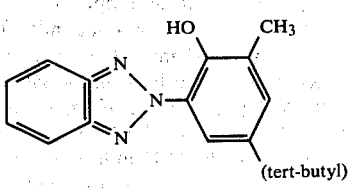

As is apparent from the results shown in Table 15, the combinations of the 2-(2'-hydroxyphenyl)benzontriazole compound (f3) or (f9) (according to the present invention) with the dye compound (38), (39), (40) or (43) provided the dry image forming materials having higher light or storage stability of raw material (evaluated in terms of fogging and retention of sensitivity) than those of the comparative dry image forming materials containing no 2-(2'-hydroxyphenyl)benzotriazole compound and none or one of the comparative compounds (C8), (C9) and (C13).

The fact that the 2-(2'-hydroxyphenyl)benzotriazole compounds (f3) and (f9) as well as the comparative compounds (C8), (C9) and (C13) are incapable of absorbing light having wavelengths of 450 nm or more will indicate that the improvement in light stability of raw material achieved in the present invention should not be attributed to the function of the component (f) as the ultraviolent absorber.

EXAMPLES 79 TO 87 AND COMPARATIVE EXAMPLES 80 TO 92

A post-activation type dry image forming material was prepared in substantially the same manner as in Examples 8 to 10 except that recipe [Z] as shown below and the recipe [Y] as used in Examples 71 to 78 were used instead of the recipes [E] and [F], respectivity.

| Recipe [Z] | |
|---|---|
| Silver behenate suspension | 1.5 g |
| 15 Weight % solution of polyvinyl butyral in methyl ethyl ketone | 1.3 g |
| Iodine | 8 mg |
| Triphenyl phosphite | 4 mg |
| Diphenylbromomethane | 4 mg |
| Solution of 100 mg of mercuric acetate in 3 cc of methanol | 0.15 cc |
| α,α,α',α'-Tetrabromo-o-xylene | 30 mg |
| Solution of 10 mg of dye compound as shown in Table 16 in 10 cc of methanol | 0.2 cc |
| 2-(2'-Hydroxyphenyl)benzotriazole compound as indicated in Table 16 (according to the present invention) | 35 mg |
| 1-Phenyl-2,3-dimethyl-3-pyrazolin-5-one | 30 mg |

A comparative dry image forming material was prepared in substantially the same manner as described above except that the use of the 2-(2'-hydroxyphenyl)-benzotriazole compound was omitted.

The relative sensitivity, fogging and retention of sensitivity of each dry image forming material were examined in the same manner as in Examples 71 to 78 and Comparative Examples 69 to 79 except that the image formation was carried out in substantially the same manner as in Examples 52 to 66 and Comparative Examples 53 to 68, and were found to be as shown in Table 16, in which the standard material with a relative sensitivity of 100 is of Example 79.

TABLE 16

| Run No. | Dye Compound | 2-(2'-Hydroxyphenyl)-benzotriazole Compound | Before Accelerated Deterioration: Relative Sensitivity | Before Accelerated Deterioration: Fogging (O.D. min) | After Accelerated Deterioration, Heat and Humidity: Retention of Sensitivity (%) | After Accelerated Deterioration, Heat and Humidity: Fogging (O.D. min) | After Accelerated Deterioration, Filtered Light: Retention of Sensitivity (%) | After Accelerated Deterioration, Filtered Light: Fogging (O.D. min) |
|---|---|---|---|---|---|---|---|---|
| Example 79 | (2) | (f1) | 100 | 0.09 | 75 | 0.12 | 70 | 0.11 |
| Example 80 | (3) | (f3) | 201 | 0.09 | 96 | 0.12 | 90 | 0.11 |
| Example 81 | (7) | (f1) | 280 | 0.09 | 90 | 0.12 | 90 | 0.11 |
| Example 82 | (8) | (f1) | 300 | 0.09 | 98 | 0.12 | 95 | 0.11 |
| Example 83 | (13) | (f5) | 82 | 0.10 | 60 | 0.13 | 50 | 0.12 |
| Example 84 | (20) | (f6) | 80 | 0.10 | 59 | 0.13 | 52 | 0.12 |
| Example 85 | (21) | (f8) | 80 | 0.10 | 58 | 0.13 | 51 | 0.12 |
| Example 86 | (29) | (f10) | 251 | 0.09 | 60 | 0.13 | 54 | 0.12 |
| Example 87 | (48) | (f11) | 202 | 0.09 | 96 | 0.12 | 93 | 0.11 |
| Comparative Example 80 | none | none | 0 | 0.08 | 0 | 0.20 | 0 | 0.11 |
| Comparative Example 81 | (2) | none | 102 | 0.09 | 40 | 0.37 | 35 | 0.27 |
| Comparative Example 82 | (3) | none | 203 | 0.09 | 43 | 0.33 | 40 | 0.18 |
| Comparative Example 83 | (7) | none | 280 | 0.09 | 41 | 0.26 | 35 | 0.17 |
| Comparative Example 84 | (8) | none | 300 | 0.09 | 45 | 0.25 | 45 | 0.16 |
| Comparative Example 85 | (13) | none | 72 | 0.32 | 29 | 0.35 | 25 | 0.25 |
| Comparative Example 86 | (20) | none | 70 | 0.30 | 30 | 0.35 | 22 | 0.27 |
| Comparative Example 87 | (21) | none | 71 | 0.30 | 31 | 0.37 | 25 | 0.26 |
| Comparative Example 88 | (29) | none | 253 | 0.09 | 43 | 0.30 | 41 | 0.16 |
| Comparative Example 89 | (48) | none | 201 | 0.09 | 45 | 0.30 | 42 | 0.17 |
| Comparative Example 90 | (D-k) | none | 53 | 0.22 | 12 | 0.27 | 11 | 0.24 |
| Comparative Example 91 | (D-l) | none | 0 | 0.32 | 0 | 0.32 | 0 | 0.30 |
| Comparative Example 92 | (D-m) | none | 0 | 0.31 | 0 | 0.33 | 0 | 0.30 |

The dye compounds (D-k), (D-l) and (D-m) used herein are mentioned below.

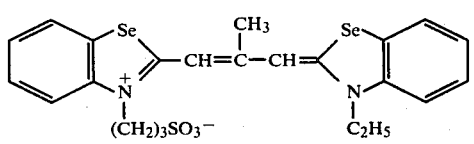

(D-k)

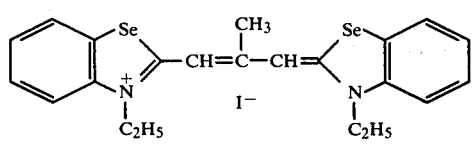

(D-l)

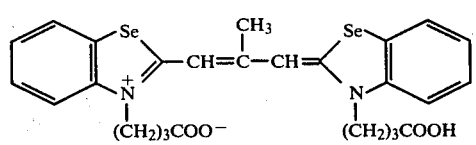

(D-m)

As is apparent from the results shown in Table 16, the combinations of the 2-(2'-hydroxyphenyl)benzotriazole compound (f1), (f3), (f5), (f6), (f8), (f10) or (f11) (according to the present invention) with the dye compound (2), (3), (7), (8), (13), (20), (21), (29) or (48) provided the dry image forming materials having higher light or storage stability of raw material (evaluated in terms of fogging and retention of sensitivity) than those of the comparative dry image forming materials containing no 2-(2'-hydroxyphenyl)benzotriazole compound.

A piece of each of the dry image forming materials prepared in Examples 79 and 80, and 83 to 87, and Comparative Example 82 was heat-activated on a hot plate maintained at about 100° C. in the dark for 3 seconds, and then put into a 35 mm still camera, followed by taking a photograph of an NBS resolution test chart of 100 lines/mm (NBS; National Bureau of Standards). The material was then heat-developed on a hot plate maintained at about 125° C. for 4 seconds. The minimum optical density (O.D.min) between the photographed lines were measured by using a Sakura Microdensitometer PDM-5 (trade name of a microdensitometer manufactured by Konishiroku Photo Ind. Co. Ltd., Japan). In general, that the O.D.min of an image forming material is lower proves that the material is less subject to the influences of halation or irradiation, leading to a high quality image.

The results are shown in Table 17.

TABLE 17

| Example No. | O.D.min between Lines (100 lines/mm) |
|---|---|
| Example 79 | 0.26 |
| Example 80 | 0.26 |
| Example 83 | 0.27 |
| Example 84 | 0.24 |
| Example 85 | 0.24 |
| Example 86 | 0.25 |
| Example 87 | 0.25 |
| Comparative | |

TABLE 17-continued

| Example No. | O.D.min between Lines (100 lines/mm) |
|---|---|
| Example 82 | 0.58 |

As is apparent from the results shown in Table 17, the combinations of the 2-(2'-hydroxyphenyl)benzotriazole compound (f1), (f3), (f5), (f6), (f8), (f10) or (f11) (according to the present invention) with the dye compound (2), (3), (13), (20), (21), (29) or (48) provided the dry image forming materials which were less subject to the influences of halation and irradiation, producing high quality images with a high resolution and a low O.D.min even in narrow areas between imaged lines.

EXAMPLES 88 TO 97 AND COMPARATIVE EXAMPLES 93 TO 102

A post-activation type dry image forming materials was prepared in substantially the same manner as in Examples 8 to 10 except that recipes [α] and [β] as shown below were used instead of the recipes [E] and [F], respectively.

| | |
|---|---|
| Recipe [α] | |
| Silver behenate suspension | 1.5 g |
| 15 Weight % solution of polyvinyl butyral in methyl ethyl ketone | 1.3 g |
| Solution of 100 mg of mercuric acetate in 3 cc of methanol | 0.15 cc |
| Iodine | 8 mg |
| Triphenyl phosphite | 4 mg |
| Diphenylbromomethane | 4 mg |
| 1-Phenyl-2,3-dimethyl-3-pyrazolin-5-one | 30 mg |
| α,α,α',α'-Tetrabromo-o-xylene | 35 mg |
| Solution of 10 mg of dye compound as indicated in Table 18 in 10 cc of methanol | 0.1 cc |
| 2-(2'-Hydroxyphenyl)benzotriazole compound as indicated in Table 18 (according to the present invention) | 35 mg |
| Recipe [β] | |
| Acrylic resin (AR-a) | 6.3 g |
| 2,2'-Methylenebis(4-ethyl-6 tert-butylphenol) | 3.5 g |
| Phthalazinone | 1.2 g |
| Methyl ethyl ketone | 83.0 g |

A comparative dry image forming material was prepared in substantially the same manner as described above except that the use of the 2-(2'-hydroxyphenyl)-benzotriazole compound was omitted, or that a comparative compound as indicated in Table 18 was used instead of the 2-(2'-hydroxyphenyl)benzotriazole compound.

With respect to each dry image forming material, the O.D.min between the photographed lines were measured in the same manner as described in Example 79 to 87 and Comparative Examples 80 to 92. The results are shown in Table 18.

TABLE 18

| Run No. | Dye Compound | 2-(2'-Hydroxyphenyl)-benzotriazole Compound or Comparative Compound | O.D.min between Lines (100 lines/mm) |
|---|---|---|---|
| Example 88 | (1) | (f3) | 0.25 |
| Example 89 | (3) | (f4) | 0.24 |
| Example 90 | (4) | (f5) | 0.26 |
| Example 91 | (8) | (f1) | 0.24 |
| Example 92 | (10) | (f2) | 0.25 |

TABLE 18-continued

| Run No. | Dye Compound | 2-(2'-Hydroxyphenyl)-benzotriazole Compound or Comparative Compound | O.D.min between Lines (100 lines/mm) |
|---|---|---|---|
| Example 93 | (25) | (f4) | 0.26 |
| Example 94 | (28) | (f5) | 0.26 |
| Example 95 | (29) | (f8) | 0.27 |
| Example 96 | (40) | (f9) | 0.27 |
| Example 97 | (43) | (f1) | 0.27 |
| Comparative Example 93 | (1) | none | 0.57 |
| Comparative Example 94 | (4) | none | 0.62 |
| Comparative Example 95 | (10) | none | 0.60 |
| Comparative Example 96 | (25) | none | 0.57 |
| Comparative Example 97 | (29) | none | 0.60 |
| Comparative Example 98 | (1) | (C2) | 0.62 |
| Comparative Example 99 | (4) | (C3) | 0.60 |
| Comparative Example 100 | (10) | (C8) | 0.58 |
| Comparative Example 101 | (25) | (C9) | 0.56 |
| Comparative Example 102 | none | none | 0.18 |

As is apparent from the results shown in Table 18, the combinations of the 2-(2'-hydroxyphenyl)benzotriazole compound (f1), (f2), (f3), (f4), (f5), (f8) or (f9) with the dye compound (1), (3), (4), (8), (10), (25), (28), (29), (40) or (43) provided the dry image forming materials which were less subject to the influences of halation and irradiation, producing high quality images with a high resolution and a low O.D.min even in narrow areas between imaged lines.

EXAMPLE 98

A post-activation type dry image forming material was prepared in substantially the same manner as in Example 79 except that 5 mg of palladium (II) acetylacetonate and 5 mg of cobalt (III) acetylacetonate were used instead of the methanol solution of mercuric acetate and that 20 mg of iodine was used instead of 8 mg of the same. The results evaluated with respect to stability of the raw material in the same manner as in Example 79 were substantially the same as those obtained in Example 79.

The Izod impact strengths (notched) of the high impact acrylic resins used herein were examined in accordance with ASTM D 256 and found to be as shown in Table 19.

TABLE 19

| High Impact Acrylic Resin | Izod Impact Strength (Notched) (ft · lb/in) |
|---|---|
| Acrylic Resin (AR-a) | 0.93 |
| Acrylic Resin (AR-b) | 0.95 |
| Acrylic Resin (AR-c) | 0.70 |
| Acrylic Resin (AR-d) | 0.87 |
| Acrylic Resin (AR-e) | 0.52 |
| Acrylic Resin (AR-f) | 0.42 |
| Acrylic Resin (AR-g) | 1.55 |

The Izod impact strength (notched) of the polymethyl methacrylate used herein was 0.30.

What is claimed is:

1. A dry image forming material comprising in one or more layers on a support:

(a) a non-photosensitive organic silver salt oxidizing agent, (b) a reducing agent for silver ions, (c) a silver halide component of a silver halide-forming component capable of forming a silver halide component by the reaction thereof with the component (a), (d) a toning agent, (e) a lipophilic binder, and (f) at least one member selected from the group consisting of those compounds represented by the following formulae;

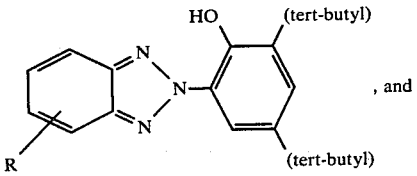

(I)

, and

-continued

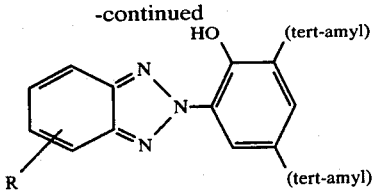

(II)

wherein R stands for a hydrogen atom, a $C_1$–$C_8$ straight or branched chain alkyl group, a $C_1$–$C_4$ straight or branched chain alkoxyl group, a phenyl group or a halogen atom selected from Cl, Br and I;

the component (f) being included in a layer containing the component (a) and being present in an amount sufficient to improve the storage stability.

2. A dry image forming material as claimed in claim 1, wherein, in the formulae (I) and (II), R is a hydrogen atom.

3. A dry image forming material as claimed in claim 1 or 2, wherein the component (f) comprises at least one compound of the formula (I).

4. A dry image forming material as claimed in claims 1 or 2, wherein the amount of the component (f) is in the range of from $1\times10^{-2}$ to $6\times10^{-1}$ mole per mole of the component (a).

* * * * *